US009412526B2

(12) United States Patent
Goto et al.

(10) Patent No.: US 9,412,526 B2
(45) Date of Patent: Aug. 9, 2016

(54) SPRING BIASED SLIDE SWITCH

(71) Applicants: Akira Goto, Guangzhou (CN); Takuya Eguchi, Aiachi (JP); Hiroaki Ota, Aichi (JP)

(72) Inventors: Akira Goto, Guangzhou (CN); Takuya Eguchi, Aiachi (JP); Hiroaki Ota, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 14/495,857

(22) Filed: Sep. 24, 2014

(65) Prior Publication Data

US 2015/0083559 A1 Mar. 26, 2015

(30) Foreign Application Priority Data

Sep. 26, 2013 (JP) ..... 2013-199138

(51) Int. Cl.

| | |
|---|---|
| ***H01H 13/00*** | (2006.01) |
| ***H01H 3/02*** | (2006.01) |
| ***H01H 15/02*** | (2006.01) |
| ***H01H 23/14*** | (2006.01) |

(52) U.S. Cl.

CPC ..... *H01H 3/02* (2013.01); *H01H 15/02* (2013.01); *H01H 23/148* (2013.01)

(58) Field of Classification Search

CPC ..... H01H 19/56; H01H 19/566; H01H 15/18; H01H 23/164; H01H 5/045; H01H 5/06; H01H 5/08; H01H 5/10

USPC ..... 200/293, 16 C, 315, 339, 434, 435

See application file for complete search history.

(56) References Cited

U.S. PATENT DOCUMENTS

| | | | | | |
|---|---|---|---|---|---|
| 3,165,603 | A * | 1/1965 | Sorenson | H01H 23/26 | 200/1 R |
| 3,995,129 | A | 11/1976 | Michalski | | |
| 4,230,919 | A * | 10/1980 | Schantz | H01H 3/161 | 200/244 |
| 4,482,791 | A | 11/1984 | Rendgen | | |
| 6,166,345 | A * | 12/2000 | Ito | H01H 5/045 | 200/437 |

(Continued)

FOREIGN PATENT DOCUMENTS

| | | |
|---|---|---|
| CN | 202134440 U | 2/2012 |
| DE | 2262995 A1 | 7/1973 |

(Continued)

OTHER PUBLICATIONS

Office Action issued in corresponding Chinese Application No. 201410498395.2, mailed on Mar. 1, 2016 (11 pages).

Office Action issued in corresponding German Application No. 102014218996.9, mailed on Mar. 22, 2016 (11 pages).

*Primary Examiner* — Vanessa Girardi

(74) *Attorney, Agent, or Firm* — Osha Liang LLP

(57) ABSTRACT

A switch includes: a case including a bottom portion and a side wall; a fixed terminal provided on the bottom portion of the case; a supporting member provided in the case; a movable contact strip supported by the supporting member so as to be pivotable in a vertical direction above the fixed terminal; a resilient member provided between the side wall of the case and the movable contact strip, and configured to urge one end portion of the movable contact strip obliquely upward; and a pressing member provided above the resilient member. The movable contact strip pivots and an opened-closed state between the movable contact strip and the fixed terminal is switched by pressing a center portion of the resilient member downward by the pressing member.

13 Claims, 17 Drawing Sheets

(56) References Cited

U.S. PATENT DOCUMENTS

| | | | | |
|---|---|---|---|---|
| 6,255,611 | B1 * | 7/2001 | Chou | H01H 3/001 200/461 |
| 6,288,352 | B1 * | 9/2001 | Fukui | H01H 13/506 200/1 R |
| 6,833,521 | B2 * | 12/2004 | Nishikawa | H01H 23/20 200/302.3 |
| 6,940,029 | B1 * | 9/2005 | Wang | H01H 23/025 200/315 |

FOREIGN PATENT DOCUMENTS

| | | | |
|---|---|---|---|
| DE | 2413002 | A1 | 10/1975 |
| DE | 3205389 | A1 | 8/1983 |
| DE | 8806213 | U1 | 6/1988 |
| DE | 4400772 | A1 | 7/1995 |
| GB | 1405451 | A | 9/1975 |
| JP | H11-185570 | A | 7/1999 |
| JP | 2006-066125 | A | 3/2006 |

* cited by examiner

B-B CROSS-SECTIONAL VIEW

C-C CROSS-SECTIONAL VIEW

D-D CROSS-SECTIONAL VIEW

E-E CROSS-SECTIONAL VIEW

F-F CROSS-SECTIONAL VIEW

G-G CROSS-SECTIONAL VIEW

SPRING BIASED SLIDE SWITCH

BACKGROUND OF THE INVENTION

1. Technical Field

One or more embodiments of the present invention relate to a switch configured to switch an opened-closed state between a movable contact strip and a fixed terminal by a pivotal movement of the movable contact strip, and a method of assembly the switch.

2. Related Art

A switch configured to switch an opened-closed state between a movable contact strip and a fixed terminal in a case by operating an operating member or the like is disclosed in, for example, JP-A-2006-66125 and JP-A-11-185570.

In a switch disclosed in JP-A-2006-66125, a contact holder including a plurality of fixed contacts fixed in one row in the lateral direction and a plurality of movable contacts mounted in one row in the lateral direction is slidably stored in a switch case formed into a box shape. An operating portion formed on the contact holder projects from an elongated hole formed in the switch case. A knob axially supported by a switch body so as to pivot is formed with an arm, and the operating portion of the contact holder engages a depression formed at a lower end of the arm. When the knob is pivoted, the arm rotates correspondingly, and the contact holder and the movable contacts slide in the lateral direction, and the opened-closed state of the movable contacts and the fixed contacts is switched.

In the switch disclosed in JP-A-11-185570, two terminals are fixed to a bottom portion of a base formed into a box shape, and a movable contact plate is provided in the base. A fixed contact is formed on one of the terminals, and the other terminal and the movable contact plate are connected. An opening on an upper portion of the base is closed by an operating handle. The operating handle is provided with a rib formed on a back thereof so as to project inward of the base, and the rib is formed with a hole. The movable contact plate is formed with a square bracket-shaped strip and an extending strip and the extending strip is provided with a movable contact formed thereon. One end portion of a coil spring is inserted into a hole on the rib, and the other end portion of the coil spring is inserted into the square bracket-shaped strip. When the operating handle is operated by a seesaw movement, the coil spring is displaced in a "<" shape or ">" shape, so that the movable contact plate pivots and the opened-closed state of the movable contact and the fixed contact is switched.

SUMMARY

In the switch as JP-A-2006-66125, the movable contacts slide leftward and rightward in association with the contact holder, and the contacts slide with respect to the fixed contacts, so that the open-close speed of the contacts, that is, the switching speed of opening and closing the contacts depends significantly on the operating speed of the knob and the contact holder. Therefore, the contact cannot be switched quickly without depending on the operating speed of the operating member.

In the switch according to JP-A-11-185570, when mounting the operating handle to the base, it is required to insert both end portions of the coil spring into the square bracket-shaped strip of the movable contact plate and a rib hole on the back side of the operating handle in the base which is not seen due to the presence of the operating handle. Therefore, assembling is difficult.

An object of one or more embodiments of the invention is to provide a switch capable of switching contact points quickly without depending on an operating speed and configured to be easy to assemble, and a method of assembling the switch.

A switch according to one or more embodiments of the invention includes: a case including a bottom portion and a side wall; a fixed terminal provided on the bottom portion of the case; a supporting member provided in the case; a movable contact strip supported by the supporting member so as to be pivotable in a vertical direction above the fixed terminal; a resilient member which is provided between the side wall of the case and the movable contact strip, and which urges one end portion of the movable contact strip obliquely upward; and a pressing member provided above the resilient member, wherein the movable contact strip pivots and an opened-closed state between the movable contact strip and the fixed terminal is switched by pressing a center portion of the resilient member downward by the pressing member.

A assembling method of the switch according to one or more embodiments of the invention includes: providing a fixed terminal on a bottom portion of a case including the bottom portion and a side wall; supporting a movable contact strip by the supporting member so as to be pivotable in a vertical direction above the fixed terminal in the case; providing a resilient member between the side wall of the case and the movable contact strip, and urging one end portion of the movable contact strip obliquely upward by the resilient member; and providing a pressing member above the resilient member.

With the configurations described above, the pressing member presses a center portion of the resilient member downward, so that the movable contact strip pivots and an opened-closed state between the movable contact strip and the fixed terminal is switched. In other words, the movable contact strip does not slide with respect to the fixed terminal, but the movable contact strip pivots and comes into contact or out of contact with the fixed terminal. Therefore, the opening-closing state of the contacts between the movable contact strip and the fixed terminal can be switched quickly without depending on the operating speed for operating the pressing member. In addition, since the fixed terminal, the supporting member, the movable contact strip, the resilient member, and the pressing member are assembled in this order upward to the box-shaped case, the switch can be assembled while viewing the respective members.

In one or more embodiments of the invention, the switch may further include an operating member provided above the case and the pressing member so as to be operable, and the pressing member presses the center portion of the resilient member in conjunction with the operation of the operating member.

In one or more embodiments of the invention, in the method of assembling the switch, the operating member may be provided above the case and the pressing member.

In one or more embodiments of the invention, the switch may further include a cover which closes an opening opened on top of the case, the pressing member may penetrate through the cover and be held by the cover so as to be movable in the vertical direction, and be supported by the center portion of the resilient member from below, and the operating member may be held by an upper portion of the cover so as to be slidable in the lateral direction in which both end portions of the movable contact strip are arranged, and include an inclined surface which presses the pressing member downward at a time of sliding movement on a surface opposing the cover.

In one or more embodiments of the invention, the switch may further include a cover which closes an opening opened on top of the case, the pressing member may include a rotating shaft, penetrate through the cover and be held by the cover so as to be rotatable in a depth direction toward a bottom portion of the case, and be supported by the resilient member from below, and the operating member may be held by an upper portion of the cover so as to be slidable in a lateral direction in which both end portions of the movable contact strip are arranged, and include an inclined surface which presses and rotates the pressing member toward the resilient member downward at a time of sliding movement on a surface opposing the cover.

In one or more embodiments of the invention, in the switch, the pressing member and the operating member may be integrally formed, supported on the case so as to allow a rotational operation in a depth direction toward the bottom portion of the case, and press the center portion of the resilient member at the time of the rotational operation.

In one or more embodiments of the invention, in the switch, the fixed terminal may include: a first fixed terminal provided with a normally-opened fixed contact; a second fixed terminal provided with a normally-closed fixed contact; and a third fixed terminal arranged between the both terminals, the supporting member may be formed of a conductive material, and mounted on the third fixed terminal, and bring the third fixed terminal and the movable contact strip into conduction, the movable contact strip may cause the one end portion to be placed on the normally-opened fixed contact, and cause the other end portion to be placed on the normally-closed fixed contact, and the resilient member may urge the one end portion of the movable contact strip obliquely upward so as to cause the one end portion of the movable contact strip to be separated from the normally-opened fixed contact, and simultaneously cause the other end portion of the movable contact strip to be brought into contact with the normally-closed fixed contact.

In one or more embodiments of the invention, in the switch, the first fixed terminal may be provided alone in the case, the second fixed terminal, the third fixed terminal, the supporting member, the movable contact strip, the resilient member, and the pressing member may be provided in left and right pairs respectively on both sides of the first fixed terminal, when the operating member is operated in a first operating direction, one of the pressing members may press a center portion of one of the resilient members and one of the movable contact strips may pivot to switch an opened-closed state between one of the normally-closed fixed contacts and the normally-opened fixed contact, and when the operating member is operated in a second operating direction, the other pressing member may press a center portion of the other resilient member and the other movable contact strip may pivot to switch an opened-closed state between the other normally-closed fixed contact and the normally-opened fixed contact.

According to one or more embodiments of the invention, a switch capable of switching contact points quickly without depending on an operating speed and configured to be easy to assemble, and a method of assembling the switch are provided.

DETAILED DESCRIPTION

Figure 1:
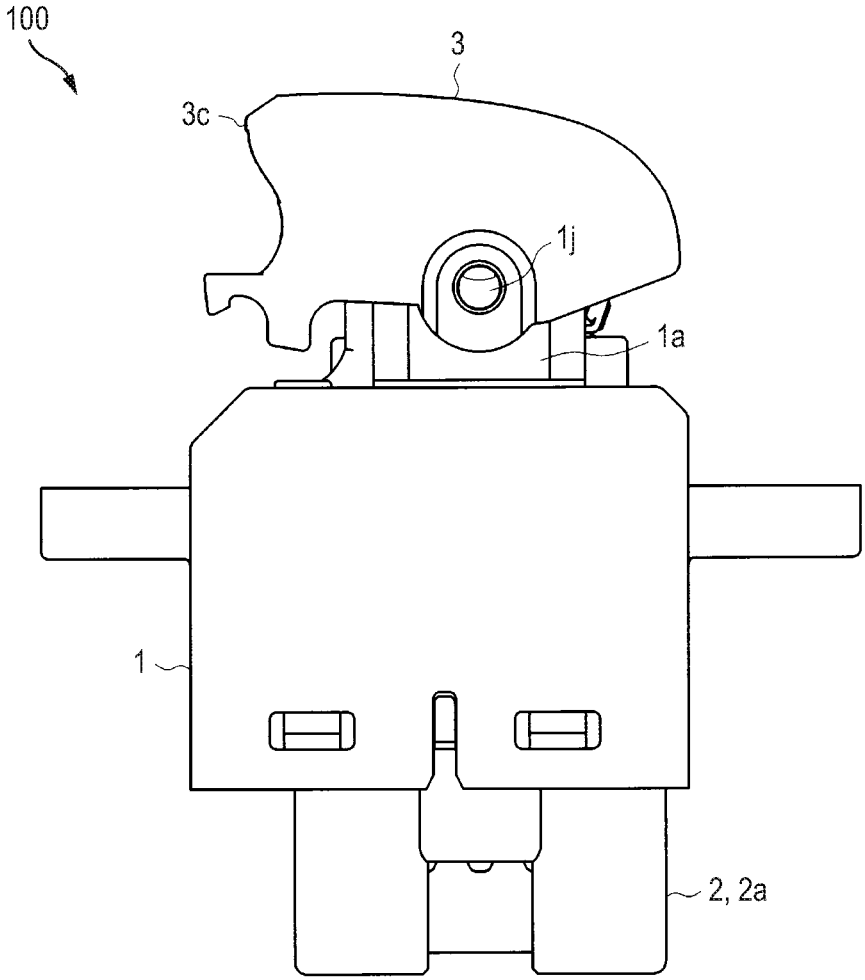
FIG. 1 is a side view of a power window switch module.

Referring now to the drawings, embodiments of the invention will be described below. In the drawings, the same or corresponding components are denoted by the same reference signs. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

FIG. 1 to FIG. 4C are drawings illustrating a power window switch module 100 of an embodiment.

Figure 2:
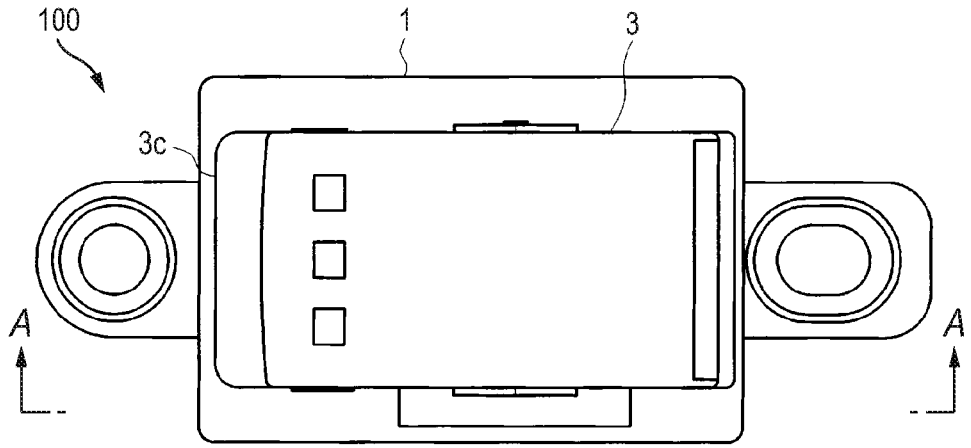
FIG. 2 is a plan view of the power window switch module illustrated in FIG. 1.
Figure 3:
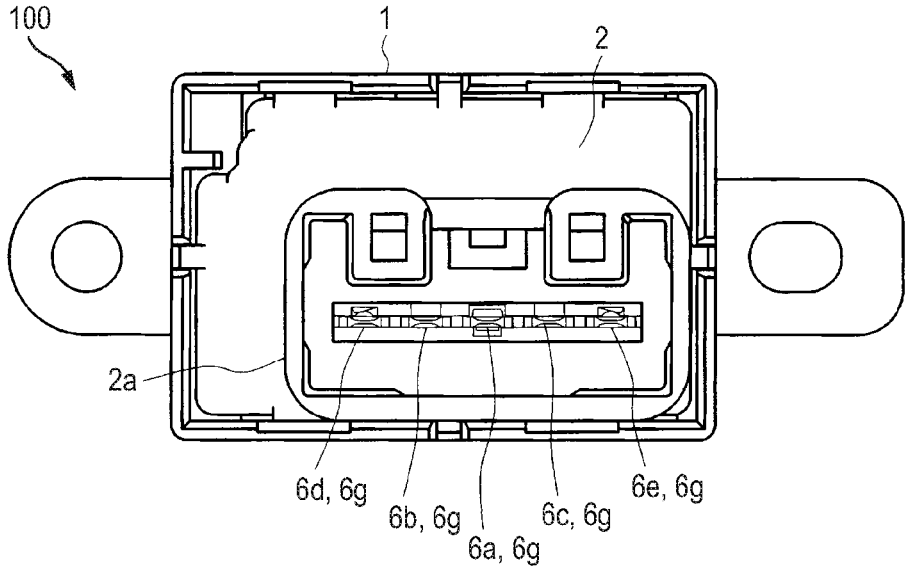
FIG. 3 is a bottom view of the power window switch module illustrated in FIG. 1.
Figure 4A:
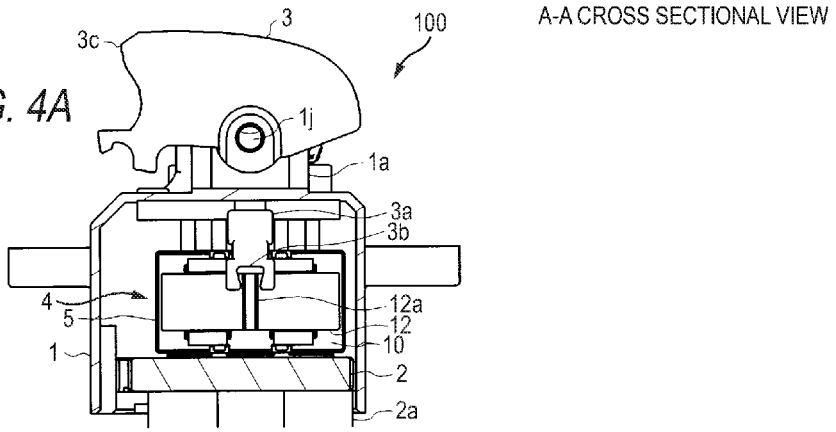
FIGS. 4A to 4C are cross-sectional views taken along the line A-A in FIG. 2.
Figure 4B:
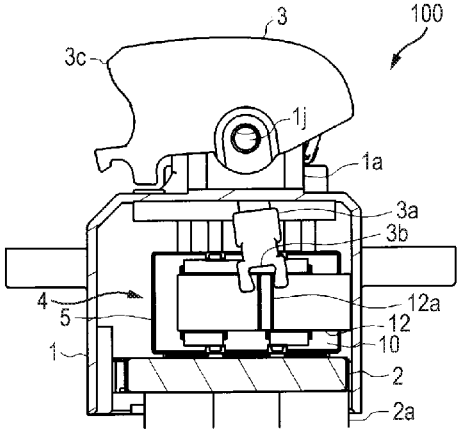
Figure 4C:
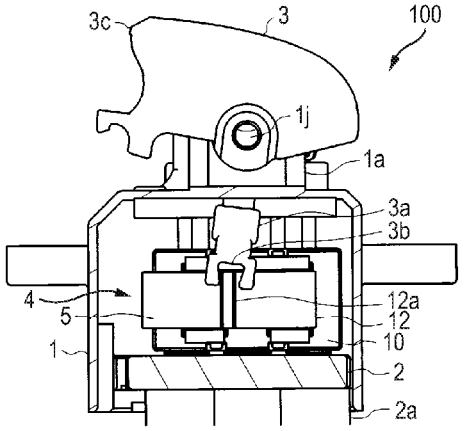

Specifically, FIG. 1 is a side view of a power window switch module 100. FIG. 2 is a plan view of the power window switch module 100. FIG. 3 is a bottom view of the power window switch module 100. FIGS. 4A to 4C are cross-sectional views taken along the line A-A in FIG. 2, illustrating an operation of the power window switch module 100.

The power window switch module 100 is configured to open and close windows other than that of a driver's seat of an automotive vehicle manually, for example, and is provided on an arm rest in the vicinity of other seats.

A module case 1 is formed into a box shape, and is closed at a lower portion thereof with a module cover 2 as illustrated in FIG. 3 and FIG. 4A to 4C. The module cover 2 is formed with a connector portion 2*a* so as to project downward as illustrated in FIG. 1.

A cylindrical portion 1*a* is formed on the module case 1. A lower portion of the cylindrical portion 1*a* communicates with the interior of the module case 1. A knob 3 is axially supported by the cylindrical portion 1*a* so as to cover an upper portion of the cylindrical portion 1*a*. The knob 3 is operated so as to pivot about a shaft 1*j* as illustrated in FIGS. 4A to 4C when opening and closing windows of other seats.

The knob 3 is provided with a lever 3*a* so as to penetrate through the cylindrical portion 1*a* and project into the module case 1. A switch 4 configured to open and close a route of a large current flowing to a motor for opening and closing the window, namely, of a direct-controlled type is stored in the module case 1.

FIG. 5 to FIG. 11C are drawings illustrating a switch $\mathbf{4}_{(1)}$ of a first embodiment.

Figure 5:
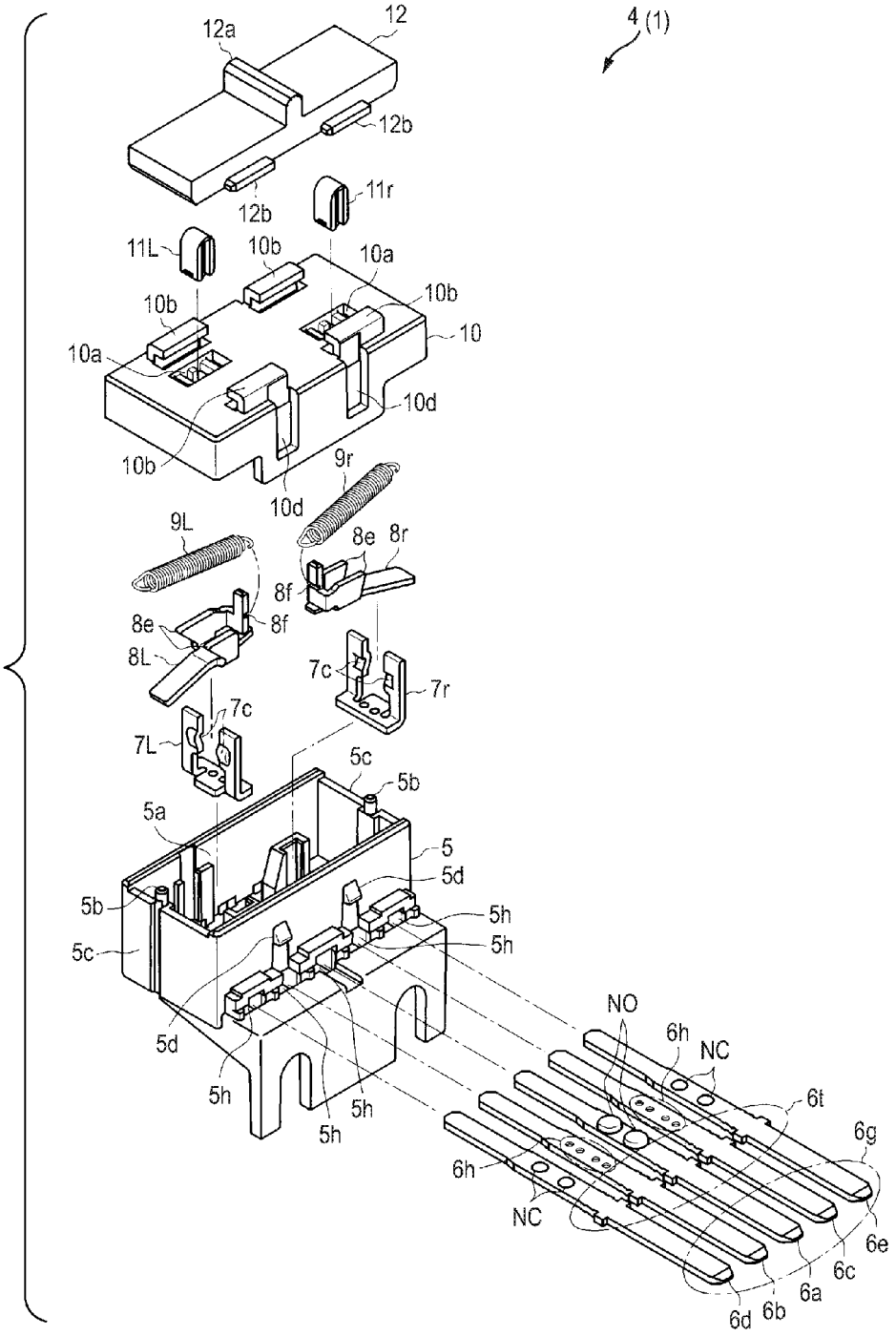
FIG. 5 is an exploded perspective view of a switch of a first embodiment of the invention.
Figure 6:
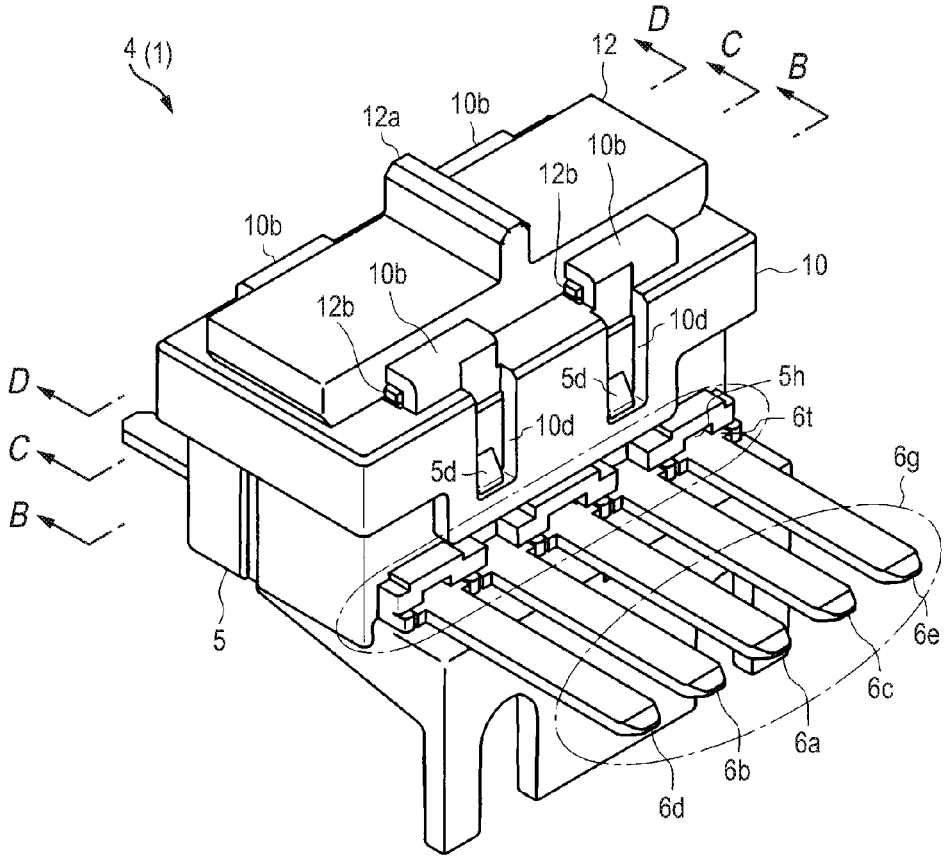
FIG. 6 is an assembly drawing of the switch in FIG. 5.
Figure 7A:
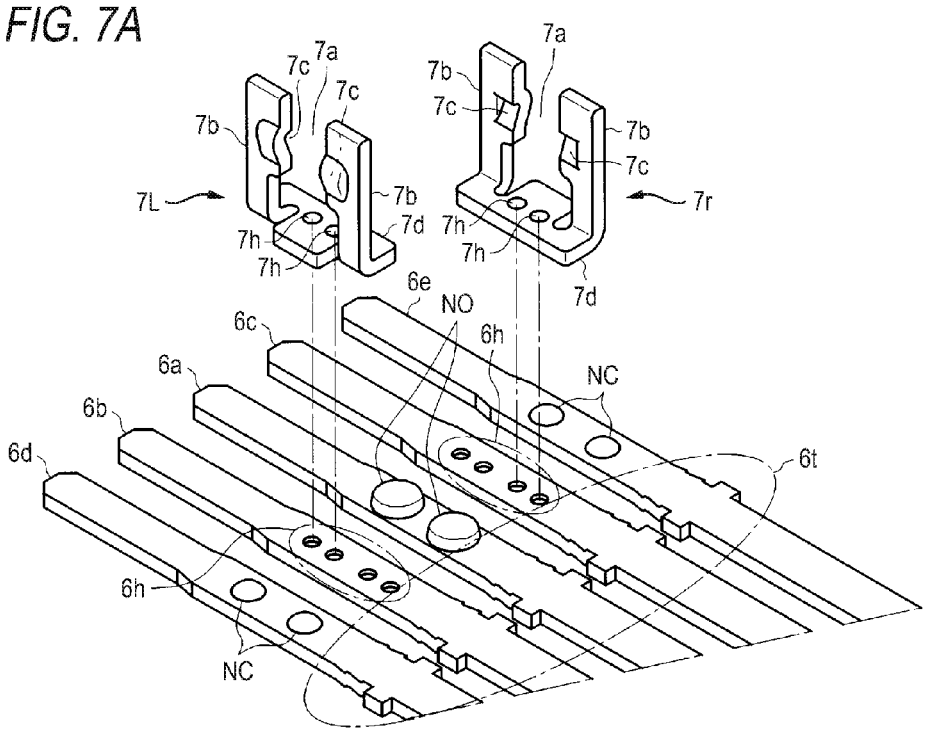
FIGS. 7A and 7E are perspective views of fixed terminals and supporting members illustrated in FIG. 5.
Figure 7B:
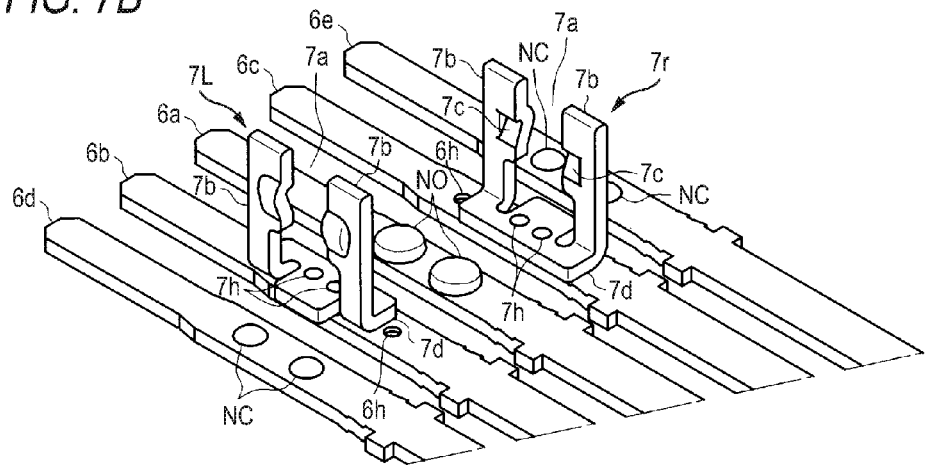
Figure 8:
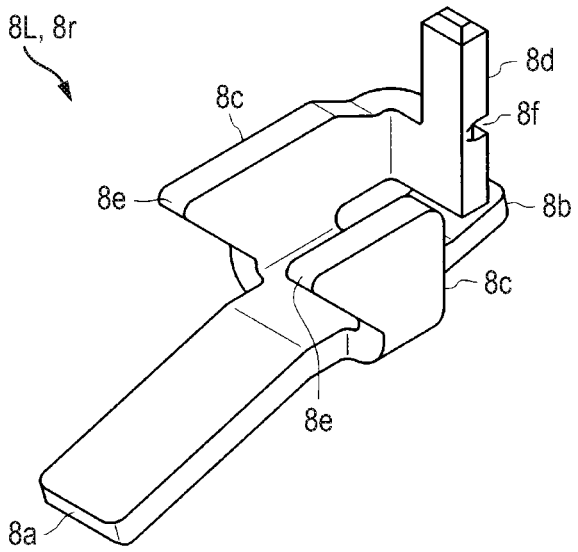
FIG. 8 is a perspective view of a movable contact strip in FIG. 5.
Figure 9:
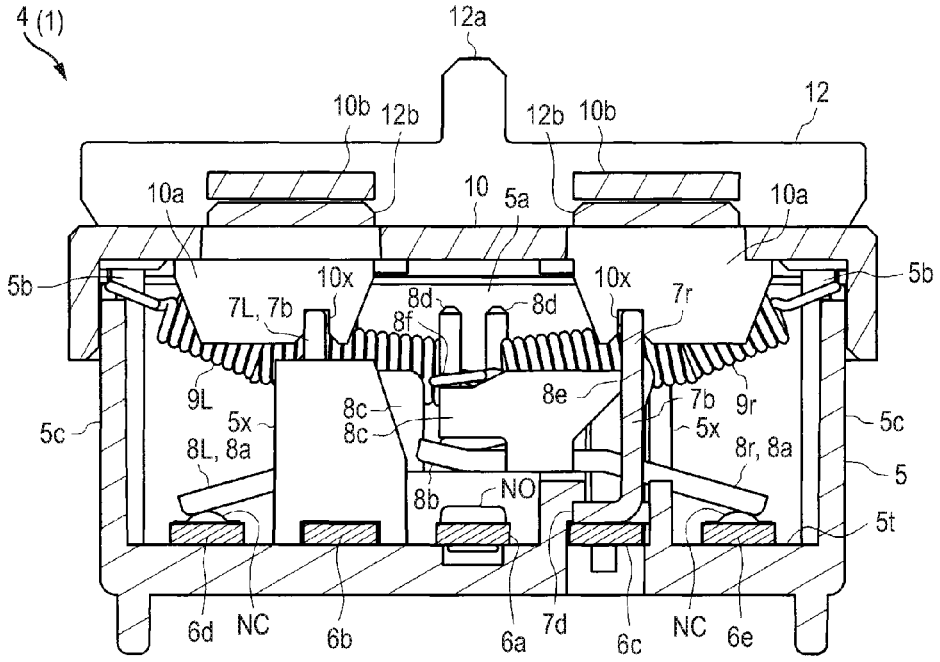
FIG. 9 is a cross-sectional view taken along the line B-B in FIG. 6.
Figure 10A:
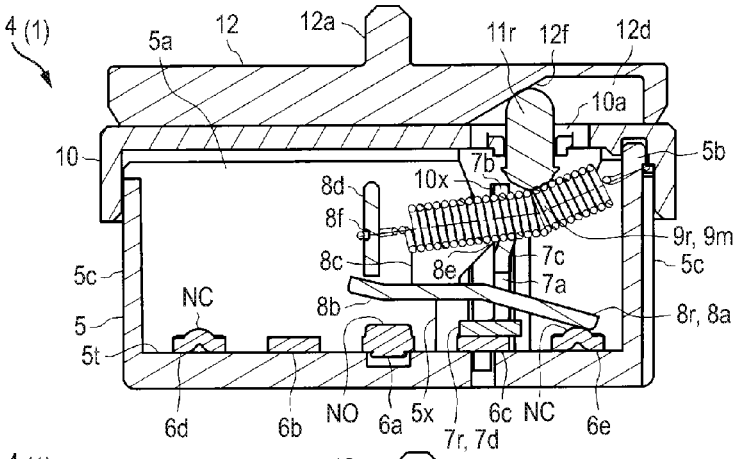
FIGS. 10A to 10C are cross-sectional views taken along the line C-C in FIG. 6.
Figure 10B:
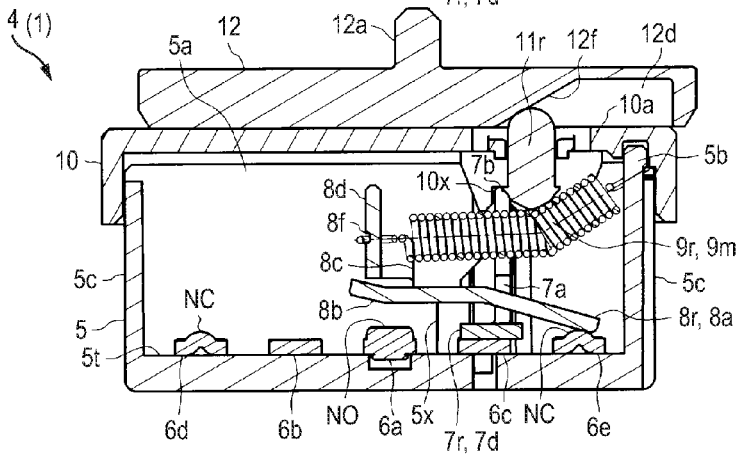
Figure 10C:
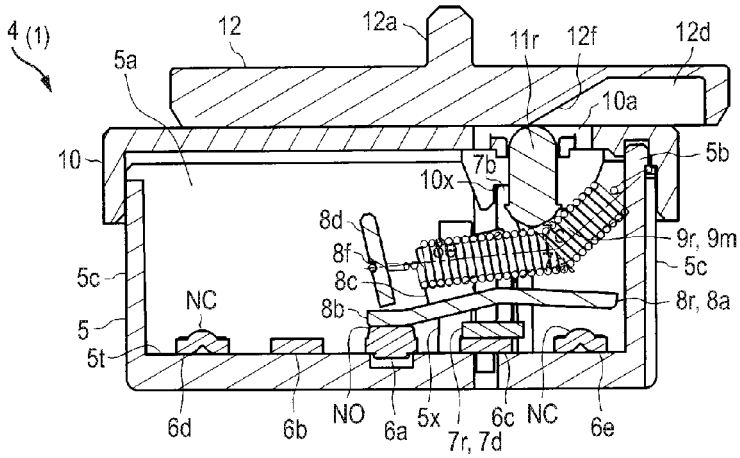
Figure 11A:
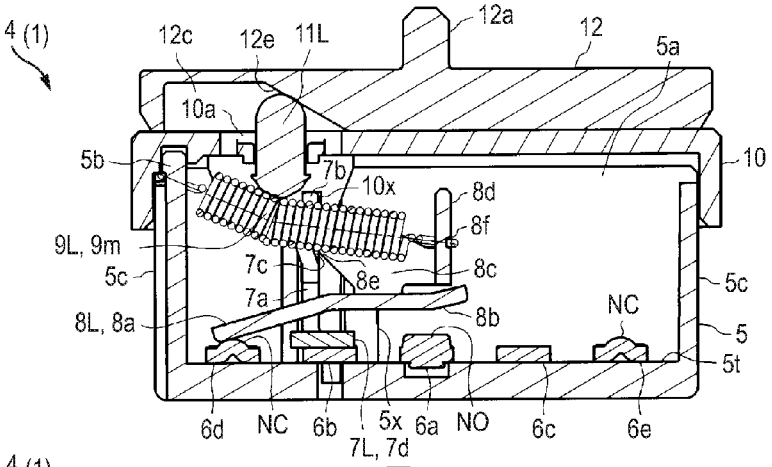
FIGS. 11A to 11C are cross-sectional views taken along the line D-D in FIG. 6.
Figure 11B:
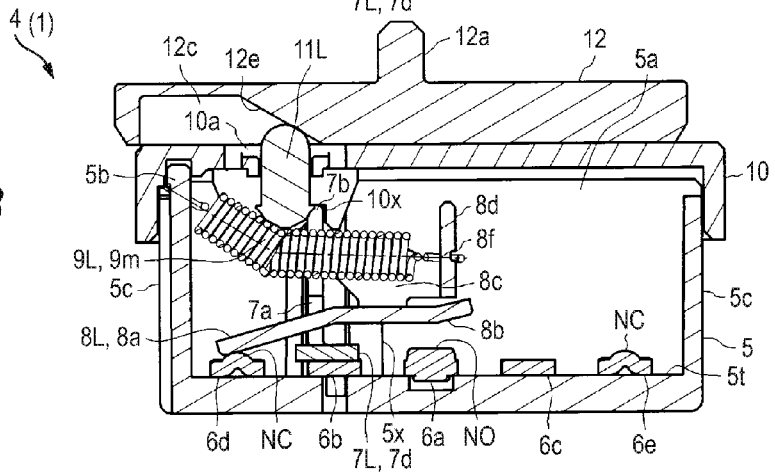
Figure 11C:
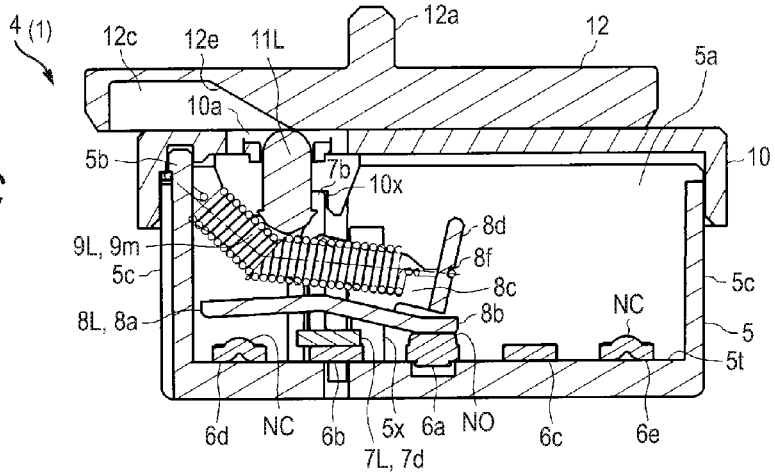

Specifically, FIG. 5 is an exploded perspective view of the switch $\mathbf{4}_{(1)}$. FIG. 6 is an assembly drawing of the switch $\mathbf{4}_{(1)}$. FIGS. 7A and 7B are perspective view of supporting members 7L and 7*r* and fixed terminals 6*a* to 6*e* provided on the switch $\mathbf{4}_{(1)}$. FIG. 8 is a perspective view of movable contact strips 8L and 8*r* provided on the switch $\mathbf{4}_{(1)}$. FIG. 9 is a cross-sectional view taken along the line B-B in FIG. 6; FIGS. 10A to 10C are cross-sectional views taken along the line C-C in FIG. 6 illustrating an operation of the switch $\mathbf{4}_{(1)}$. FIGS. 11A to 11C are cross-sectional views taken along the line D-D in FIG. 6 illustrating an operation of the switch $\mathbf{4}_{(1)}$.

As illustrated in FIG. 5, the switch $\mathbf{4}_{(1)}$ includes a case 5, fixed terminals 6*a*, 6*b*, 6*c*, 6*d*, and 6*e*, supporting members 7L and 7*r*, movable contact strips 8L and 8*r*, resilient members 9L and 9*r*, a cover 10, pressing members 11L and 11*r*, and an operating member 12.

The case 5, the cover 10, the pressing members 11L and 11*r*, and the operating member 12 are formed of a synthetic resin. The fixed terminals 6*a*, 6*b*, 6*c*, 6*d*, and 6*e*, the supporting members 7L and 7*r*, and the movable contact strips 8L and 8*r* are formed of a conductive material such as copper. The resilient members 9L and 9*r* are formed of a metal.

The case 5 is formed into a box shape, opens on top, and includes a bottom portion 5*t* and side walls 5*c*. The case 5 is provided with five through holes 5*h* on each of both side walls (reference numeral is omitted) extending in parallel to the longitudinal direction thereof (in FIG. 5, only the through holes 5*h* on one of the side walls are illustrated). The five through holes 5*h* are arranged in the longitudinal direction of the case 5 on each side wall.

Five fixed terminals 6*a*, 6*b*, 6*c*, 6*d*, and 6*e* are provided. The first fixed terminal 6*a* is provided with two normally-opened fixed contacts NO at a center thereof. The second fixed terminals 6*d* and 6*e*, which are two of the five terminals, are each provided with two normally-closed fixed contacts NC at centers thereof. The third fixed terminals 6*b* and 6*c*, which are two of the five terminals, are each provided with two pairs of pair of holes 6*h* at a center portion thereof. The fixed terminals 6*a* to 6*e* each are provided with a press-fitted portion 6*t* at centers thereof.

From the state illustrated in FIG. 5, the respective fixed terminals 6*a* to 6*e* are inserted through the respective through holes 5*h* of the case 5, and the respective press-fitted portions 6*t* are press-fitted to the side wall of the respective through holes 5*h* as illustrated in FIG. 6. Accordingly, the fixed terminals 6*a* to 6*e* are fixed to the case 5, and the fixed terminals 6*a* to 6*e* are arranged on the bottom portion 5*t* of the case 5 as illustrated in FIG. 9 to FIG. 11C.

The first fixed terminal 6*a* is arranged at a center of the case 5, a pair of left and right second fixed terminals 6*d* and 6*e* are arranged on both sides of the first fixed terminal 6*a*, and a pair of left and right third fixed terminals 6*b* and 6*c* are arranged between the first fixed terminal 6*a* and the second fixed terminals 6*d* and 6*e*. The third fixed terminals 6*b* and 6*c* function as common fixed contacts (COM).

Two each of the supporting members 7L and 7*r*, the movable contact strips 8L and 8*r*, the resilient members 9L and 9*r*, and the pressing members 11L and 11*r* are provided in pairs on the left and the right on both sides of the first fixed terminal 6*a*.

As illustrated in FIGS. 7A and 7B, each of the supporting members 7L and 7*r* is provided with a depression 7*a* formed thereon, and each of the perpendicular portions 7*b* on both sides of the depression 7*a* is provided with a depressed portion 7*c* formed thereon. The depressed portions 7*c* are depressed so as to open toward the first fixed terminal 6*a*. Horizontal portions 7*d* provided on a lower portion of the supporting members 7L and 7*r* are each provided with a pair of holes 7*h*.

The supporting members 7L and 7*r* are inserted into the interior of the case 5 from an upper opening 5*a* as illustrated in FIG. 5, and then are placed on the third fixed terminals 6*b* and 6*c* with the pair of holes 7*h* communicating with the pair of holes 7*h* of the third fixed terminals 6*b* and 6*c*, and are fixed to the third fixed terminals 6*b* and 6*c* by fixing device such as metallic depositing or welding as illustrated in FIGS. 7A and 7B. Accordingly, as illustrated in FIGS. 9 to 11C, the supporting members 7L and 7*r* are provided upright on the third fixed terminals 6*b* and 6*c* respectively so as to be conductible in the case 5. The supporting members 7L and 7*r* are held at the perpendicular portions 7*b* by side holding portions 5*x* provided on the case 5 from the sides.

As illustrated in FIG. 8, the movable contact strips 8L and 8*r* each includes both end portions 8*a* and 8*b* extending in the lateral direction, two first perpendicular portions 8*c* extending upward from the center, and one second perpendicular portion 8*d* continuing to one of the first perpendicular portions 8*c*. The first perpendicular portions 8*c* are each provided with a projection 8*d* at one end side thereof. The second perpendicular portion 8*d* is positioned on end portion 8*b* and includes a notch 8*f* formed therein.

The movable contact strips 8L and 8*r* are inserted into the case 5 from above as illustrated in FIG. 5, and then are inserted into the depression 7*a* of the supporting members 7L and 7*r*, and the respective projections 8*e* (FIG. 8) are engaged with the respective depressed portions 7*c* (FIGS. 7A and 7B) of the supporting members 7L and 7*r* (see FIG. 9). Then ends of the resilient members 9L and 9*r* formed of a tension coil spring are hooked respectively on the notches 8*f* of the movable contact strips 8L and 8*r*, and the other ends of the resilient members 9L and 9*r* are hooked on bosses 5*b* (FIG. 5) provided upright on the both side walls 5*c* extending in parallel with the short side direction of the case 5, respectively.

As illustrated in FIG. 9 to FIG. 11C, the movable contact strips 8L and 8*r* are supported by the supporting members 7L and 7*r* so as to be pivotable in the vertical directions above the fixed terminals 6*a* to 6*e*. End portions 8*b* of the movable contact strips 8L and 8*r* are positioned on the normally-opened fixed contacts NO of the first fixed terminal 6*a*, and the other end portions 8*a* thereof are positioned on the normally-closed fixed contacts NC on the second fixed terminals 6*d* and 6*e*. Furthermore, the resilient members 9L and 9*r* are hung between the side walls 5*c* of the case 5 and the movable contact strips 8L and 8*r* respectively to urge the end portions 8*b* of the movable contact strips 8L and 8*r* obliquely upward, respectively. Therefore, end portions 8*b* of the movable contact strips 8L and 8*r* are separated from the normally-opened fixed contacts NO, and the other end portions 8*a* are in contact with the normally-closed fixed contacts NC.

As illustrated in FIG. 5, the both side walls of the cover 10 extending in parallel with the longitudinal direction thereof are each provided with a pair of lock holes 10*d* (In FIG. 5, only the lock hole 10*d* on one of the side walls are illustrated.). The cover 10 is provided with a pair of first holding portions 10*a* configured to hold the pressing members 11L and 11*r* so as to be movable upward and downward. The first holding portions 10*a* are composed of a hole or the like penetrating through the cover 10 in the vertical direction.

The cover 10 is provided with a plurality of second holding portions 10*b* configured to hold the operating member so as to be slidable in the lateral direction (the longitudinal direction of the case 5, the cover 10, and the operating member 12, that is, the direction in which the both end portions 8*a* and 8*b* of the movable contact strips 8L and 8*r* are arrayed) at an upper portion thereof. The second holding portions 10*b* are formed into a groove shape so as to extend in the longitudinal direction of the cover 10.

As illustrated in FIG. 6, the respective locking holes 10*d* of the cover 10 and the respective projections 5*d* (in FIG. 5, only the projection 5*d* on one of the side walls is illustrated) formed on the both side walls of the case 5 extending in parallel with the longitudinal direction thereof are fitted. Accordingly, the cove 10 is attached on the case 5, and the opening 5*a* is covered with the cover 10 (see also FIG. 9 to FIG. 11C).

The pressing members 11L and 11*r* are mounted on the respective first holding portions 10*a* of the cover 10 from above. Accordingly, as illustrated in FIGS. 10A to 10C and FIGS. 11A to 11C, the pressing members 11L and 11*r* penetrate through the cover 10, and are held by the cover 10 so as to be movable upward and downward. The pressing members 11L and 11*r* are supported by center portions 9*m* of the resilient members 9L and 9*r* from below. Upper holding portions 10*x* configured to hold upper end portions of the supporting members 7L and 7*r* are formed at lower ends of the first holding portions 10*a*.

As illustrated in FIG. 5, the both side walls of the operating member 12 extending in parallel with the longitudinal direction are provided with projection 12*b* so as to extend in the longitudinal direction (in FIG. 5, the projections 12*b* of only one of the side walls are illustrated). A operating portion 12*a* is formed so as to project upward at a center of the upper portion of the operating member 12.

The projections 12*b* of the operating member 12 are inserted into the second holding portions 10*b* of the cover 10 in parallel to the longitudinal direction of the cover 10 and the operating member 12. Accordingly, as illustrated in FIG. 6 and FIG. 9 to FIGS. 11A to 11C, the operating member 12 is held on an upper portion of the cover 10 so as to be slidable in the lateral direction above the case 5 and the pressing members 11L and 11*r*.

The lower surface of the operating member 12 opposing the cover 10 is provided with engaging grooves 12*c* and 12*d* that allow engagement of upper ends of the pressing members 11L and 11*r* as illustrated in FIGS. 10A to 10C and 11A to 11C. The engaging grooves 12*c* and 12*d* are provided with inclined surfaces 12*e* and 12*f* so as to be lower as they go toward the operating portion 12*a*.

When assembling the switch $\mathbf{4}_{(1)}$ having the configuration described above, the fixed terminals 6*a* to 6*e* are press fitted to the respective through holes 5*h* of the case 5 first, and the fixed terminals 6*a* to 6*e* are provided on the bottom portion 5*t* of the case 5. Subsequently, the supporting members 7L and 7*r* are provided upright on the third fixed terminals 6*b* and 6*c* in the case 5. Subsequently, the movable contact strips 8L and 8*r* are provided above the fixed terminals 6*a* to 6*e* in the case 5, and the movable contact strips 8L and 8*r* are supported by the supporting members 7L and 7*r* so as to be pivotable upward and downward. The resilient members 9L and 9*r* are provided between the respective side walls 5*c* of the case 5 and the movable contact strips 8L and 8*r*, and the end portions 8*b* of the movable contact strips 8L and 8*r* are urged obliquely upward by the resilient members 9L and 9*r*. Subsequently, the cover 10 is mounted on the case 5 and the opening 5*a* is closed with the cover 10. The pressing members 11L and 11*r* are mounted on the first holding portions 10*a* of the cover 10, and the pressing members 11L and 11*r* are provided above the resilient members 9L and 9*r*. The operating member 12 is mounted on the second holding portions 10*h* of the cover 10, so that the operating member 12 is slidably provided above the case 5 and the pressing members 11L and 11*r*. Accordingly, the switch $\mathbf{4}_{(1)}$ is assembled as illustrated in FIG. 6, FIG. 9 to FIG. 11C.

The switch $\mathbf{4}_{(1)}$ assembled in a manner described above is installed sideways in the interior of the module case 1 of the power window switch module 100 so that the longitudinal direction (lateral direction in FIGS. 4A to 4C) and a short side direction (vertical direction in FIGS. 4A to 4C) of the case 5 extend perpendicularly to the pivotal shaft 1*j* of the knob 3 as illustrated in FIGS. 4A to 4C. The switch $\mathbf{4}_{(1)}$ is fixed by the module case 1 and the module cover 2.

The operating portion 12*a* of the operating member 12 is engaged with a depression 3*b* provided at an lower end of a lever 3*a* of the knob 3. Therefore, the lever 3*a* is pivoted in association with the pivotal movement of the knob 3 about the shaft 1*j*, to slide the operating member 12 leftward and rightward.

Respective lead portions 6*g* (FIG. 6) of the fixed terminals 6*a* to 6*e* exposed from the case 5 project into the connector portion 2*a* as illustrated in FIG. 3. Therefore, by fitting harness, not illustrated, to the connector portion 2*a*, a motor for opening and closing the window, not illustrated is electrically connected to the switch $\mathbf{4}_{(1)}$, and a route for flowing a high current to the motor is created.

Subsequently, the operation of the switch $\mathbf{4}_{(1)}$ will be described.

As illustrated in FIG. 4A, when the knob 3 is in a neutral (not operated) state, the lever 3*a* is in the perpendicular posture, and the operating member 12 is at a neutral position. As illustrated in FIG. 11A and FIG. 10A, the pressing members 11L and 11*r* are pressed at upper ends thereof by inclined portions 12*e* and 12*f* of the operating member 12, and slightly press the center portions 9*m* of the resilient members 9L and 9*r* respectively at lower ends thereof. Accordingly, the resilient members 9L and 9*r* are sagged and urge the end portions 8*b* of the movable contact strips 8L and 8*r* obliquely upward where the bosses 5*b* of the both side walls 5*c* of the case 5 are present, respectively. Therefore, the end portions 8*b* of the movable contact strips 8L and 8*r* separate from the normally-opened fixed contacts NO of the first fixed terminal 6*a*, while the other end portions 8*a* thereof are in contact with the normally-closed fixed contacts NC on the second fixed terminals 6*d* and 6*e*, respectively.

As illustrated in FIG. 10A, since the supporting member 7*r* is normally in contact with the third fixed terminal 6*c* and the movable contact strip 8*r* respectively, the third fixed terminal 6*c* and the second fixed terminal 6*e* are in conducting state via the supporting member 7*r* and the movable contact strip 8*r*. As illustrated in FIG. 11A, since the supporting member 7L is normally in contact with the third fixed terminal 6*b* and the movable contact strip 8L respectively, the third fixed terminal 6*n* and the second fixed terminal 6*d* are in conducting state via the supporting member 7L and the movable contact strip 8L. Therefore, both current routes for normal rotation and for reverse rotation of the motor for opening and closing the window are in an opened (blocked) state, and hence no current flows to the motor, whereby the motor and the window are standstill.

As illustrated in FIG. 4B, when the front end portion 3*c* of the knob 3 is pressed downward and pivots the knob 3 into an opening direction (counterclockwise in FIG. 4B), the lever 3*a* pivots and slides the operating member 12 in the first operating direction (rightward in FIG. 4B). Then, as illustrated in FIG. 10B, an upper end of a pressing member 11*r* on one (right) side slides against the inclined portion 12*f* of the operating member 12, and the pressing member 11*r* moves downward to cause the center portions 9*m* of the resilient member 9*r* further downward to be bent. In other words, in conjunction with the sliding operation of the operating member 12 in the first operating direction, the pressing member 11*r* presses the center portions 9*m* of the resilient member 9*r* downward.

As illustrated in FIG. 100, when the operating member 12 slides in the first operating direction by a predetermined amount and the pressing member 11*r* presses the center portion 9*m* of the resilient member 9*r* downward by a predetermined amount, the resilient member 9*r* is significantly bent and hence the end portions 8*b* of the movable contact strip 8*r* cannot be urged obliquely upward. The perpendicular portion 8*d* of the movable contact strip 8*r* is pulled downward by the resilient member 9*r*, and the movable contact strip 8*r* pivots by a seesaw movement counterclockwise in FIG. 10C about a projection 8*e* (FIG. 8) engaging the depressed portion 7*c* (FIGS. 7A and 7B) of the supporting member 7*r*. Then, the end portion 8*a* of the movable contact strip 8*r* moves away from the normally-closed fixed contacts NC of the second fixed terminal 6*e* and the end portions 8*b* comes into contact with the normally-opened fixed contacts NO of the first fixed terminal 6*a*. Therefore, when the third fixed terminal 6*c* and the first fixed terminal 6*a* are brought into a conducting state via the supporting member 7*r* and the movable contact strip 8*r*, and the current route for normal rotation of the motor is brought into a closed (conducting) state, whereby a current flows to the motor and the motor rotates normally, so that the window is opened.

As illustrated in FIG. 4C, when the front end portion 3*c* of the knob 3 is pulled upward and pivots the knob 3 in the closing direction (clockwise in FIG. 4C), the lever 3*a* pivots and slides the operating member 12 in the second operating direction (leftward in FIG. 40). Then, as illustrated in FIG. 11B, an upper end of the pressing member 11L on the other (left) side slides against the inclined portion 12*e* of the operating member 12, and the pressing member 11L moves downward to cause the center portions 9*m* of the resilient member 9L further downward to be bent. In other words, in conjunction with the sliding operation of the operating member 12 in the second operating direction, the pressing member 11L presses the center portions 9*m* of the resilient member 9L downward.

As illustrated in FIG. 110, when the operating member 12 slides in the second operating direction by a predetermined amount and the pressing member 11L presses the center portion 9*m* of the resilient member 9L downward by a predetermined amount, the resilient member 9L is significantly bent and hence the end portions 8*b* of the movable contact strip 8L cannot be urged obliquely upward. The perpendicular portion 8*d* of the movable contact strip 8L is pulled downward by the resilient member 9L, and the movable contact strip 8L pivots by a seesaw movement clockwise in FIG. 11C about the projection 8*e* (FIG. 8) engaging the depressed portion 7*c* (FIGS. 7A and 7B) of the supporting member 7L. Then, the other end portion 8*a* of the movable contact strip 8L moves away from the normally-closed fixed contacts NC of the second fixed terminal 6*d* and the end portions 8*b* comes into contact with the normally-opened fixed contacts NO of the first fixed terminal 6*a*. Therefore, when the third fixed terminal 6*b* and the first fixed terminal 6*a* are brought into a conducting state via the supporting member 7L and the movable contact strip 8L, and the current route for reverse rotation of the motor is brought into a closed state, whereby a current flows to the motor and the motor rotates reversely, so that the window is closed.

When the operation on the knob 3 is released, the knob 3 and the operating member 12 are restored to the neutral state illustrated in FIGS. 4A, 10A and 11A by a restoration mechanism, which is not illustrated. Therefore, the pressing members 11L and 11*r* are separated from the inclined surfaces 12*e* and 12*f* of the operating member 12, respectively, and are pushed upward by a resilient restoring force of the resilient members 9L and 9*r*, and upper ends of the pressing members 11L and 11*r* engage the engaging grooves 12*c* and 12*d*. The resilient members 9L and 9*r* urge the end portions 8*b* of the movable contact strips 8L and 8*r* obliquely upward, respectively, so that the end portions 8*b* of the movable contact strips 8L and 8*r* separate from the normally-opened fixed contacts NO of the first fixed terminal 6*a*, while the other end portions 8*a* thereof are in contact with the normally-closed fixed contacts NC on the second fixed terminals 6*d* and 6*e*, respectively. Therefore, the third fixed terminals 6*b* and 6*c* are brought into a non-conducting state with respect to the first fixed terminal 6*a*, and are brought into a conducting state with the second fixed terminals 6*d* and 6*e* via the supporting members 7L and 7*r* and the movable contact strips 8L and 8*r*, respectively. Therefore, both current routes for normal rotation and for reverse rotation of the motor are in an opened state, and hence no current flows to the motor, whereby the motor and the window are standstill.

As another example, the following configuration is also applicable. Irrespective of the presence or absence of the restoration mechanism, which is not illustrated, if the operation on the knob 3 is released, the pressing member 11L (11*r*) which is pushed upward by a resilient restoration force of the resilient member 9L (9*r*) moves along the inclined surface 12*e* (12*f*) of the operating member 12. Accordingly, the operating member 12 moves leftward (rightward), and the knob 3 is restored to the neutral state.

According to the switch $\mathbf{4}_{(1)}$ of the first embodiment, in conjunction with the sliding operation of the operating member 12 by the knob 3, the pressing members 11L and 11*r* are pressed downward by the inclined surfaces 12*e* and 12*f* of the operating member 12. Then, the center portions 9*m* of the resilient members 9L and 9*r* are pressed by the pressing members 11L and 11*r* to pivot the movable contact strips 8L and 8*r*, and the opened-closed state of the movable contact strips 8L and 8*r* and the fixed terminals 6*a* to 6*e* is switched. In other words, the movable contact strips 8L and 8*r* do not slide in the lateral direction in association with the operating member 12 against the fixed terminals 6*a* to 6*e*, but the movable contact strips 8L and 8*r* make a seesaw movement by the actions of the resilient members 9L and 9*r* and come into contact with or away from the fixed terminals 6*a* to 6*e*. Therefore, the opening-closing state of the contact between the movable contact strips 8L and 8*r* and the fixed terminals 6*a* to 6*e* can be switched quickly without depending on the operating speed of the knob 3 and the operating member 12.

In the first embodiment, the fixed terminals 6*a* to 6*e*, the supporting members 7L and 7*r*, the movable contact strips 8L and 8*r*, and the resilient members 9L and 9*r* are assembled upward in sequence in the interior of the box-shaped case 5. Then, the opening 5*a* of the case 5 is covered with the cover 10, and from the upper portion of the cover 10, the pressing members 111, and 11*r* and the operating member 12 are assembled in sequence. Therefore, assembly is easily achieved while viewing these members.

In the first embodiment described above, when the knob 3 and the operating member 12 are in neutral, the other end portions 8*a* of the movable contact strips 8L and 8*r* are brought into contact with normally-closed fixed contacts NC of the second fixed terminals 6*d* and 6*e* respectively while moving the end portion 8*b* thereof away from the normally-opened fixed contacts NO of the first fixed terminal 6*a* by a resilient urging force of the resilient members 9L and 9*r*. Therefore, the second fixed terminals 6*d* and be and the third fixed terminals 6*b* and 6*c* can be brought in conduction with each other via the movable contact strips 8L and 8*r* and the supporting members 7L and 7*r*, respectively.

In the first embodiment described above, by sliding the operating member 12 in the first operating direction via the knob 3, the movable contact strip 8*r* pivots to bring the end portion 8*b* of the movable contact strip 8*r* into contact with the normally-opened fixed contacts NO of the first fixed terminal 6*a* and, simultaneously, the other end portion 8*a* moves away from the normally-closed fixed contacts NC of the second fixed terminal 6*e*. Therefore, the first fixed terminal 6*a* and the third fixed terminal 6*c* can be brought in conduction with each other via the movable contact strip 8*r* and the supporting member 7*r*, respectively.

In the first embodiment described above, by sliding the operating member 12 in the second operating direction via the knob 3, the movable contact strip 8L pivots to bring the end portion 8*b* of the movable contact strip 8L into contact with the normally-opened fixed contacts NO of the first fixed terminal 6*a* and, simultaneously, the other end portion 8*a* moves away from the normally-closed fixed contacts NC of the second fixed terminal 6*d*. Therefore, the first fixed terminal 6*a* and the third fixed terminal 6*b* can be brought in conduction with each other via the movable contact strip 8L and the supporting member 7L, respectively.

FIG. 12 to FIG. 16C are drawings illustrating a switch $\mathbf{4}_{(2)}$ of a second embodiment.

Figure 12:
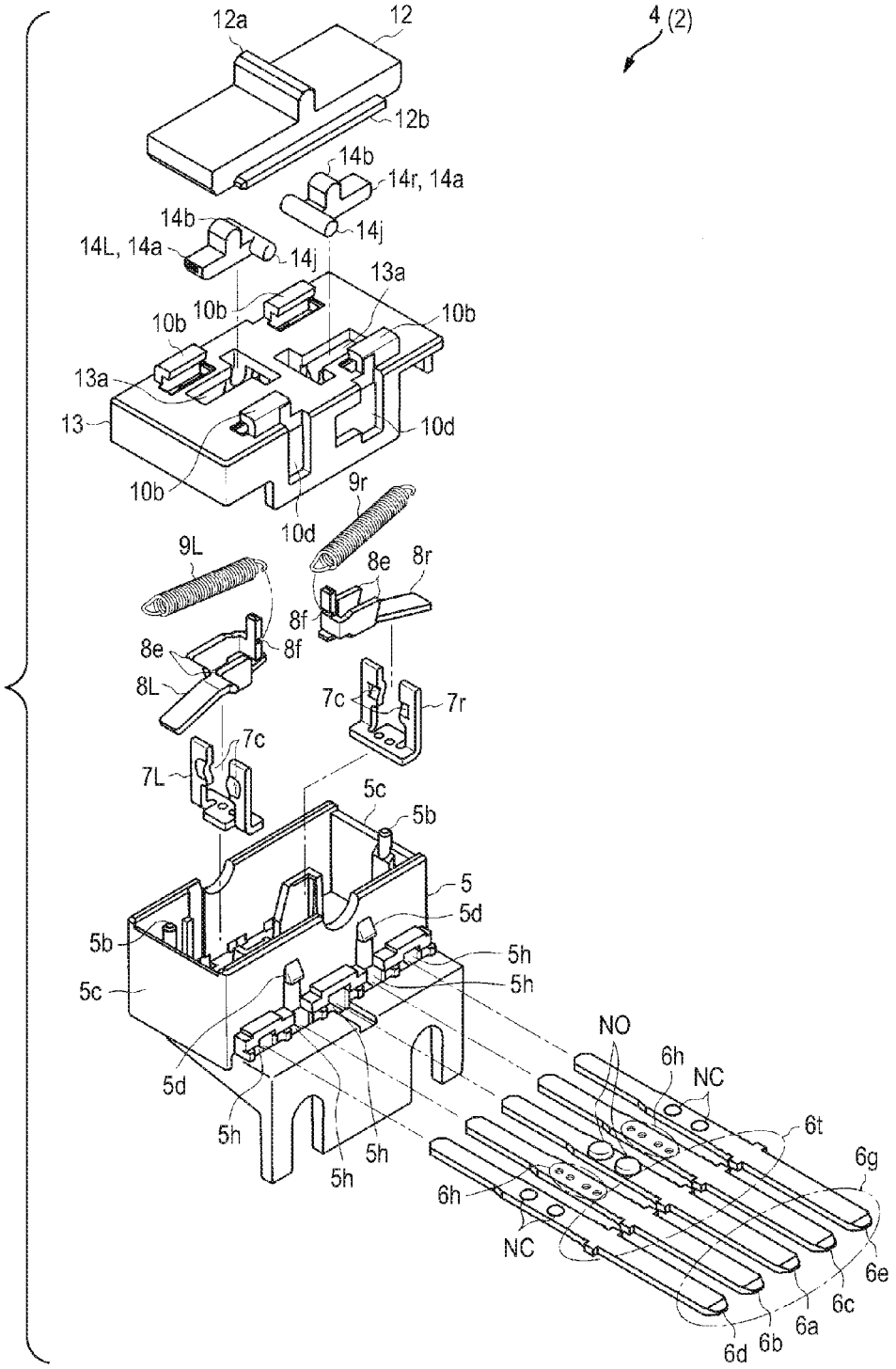
FIG. 12 is an exploded perspective view of a switch of a second embodiment of the invention.
Figure 13:
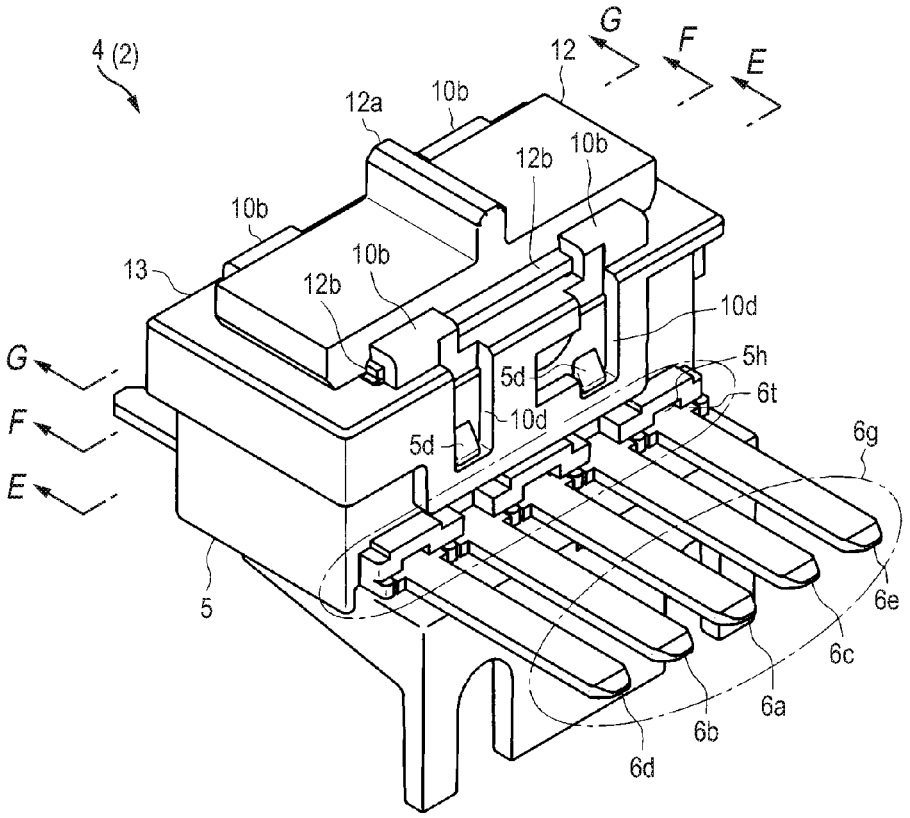
FIG. 13 is an assembly drawing of the switch in FIG. 12.
Figure 14:
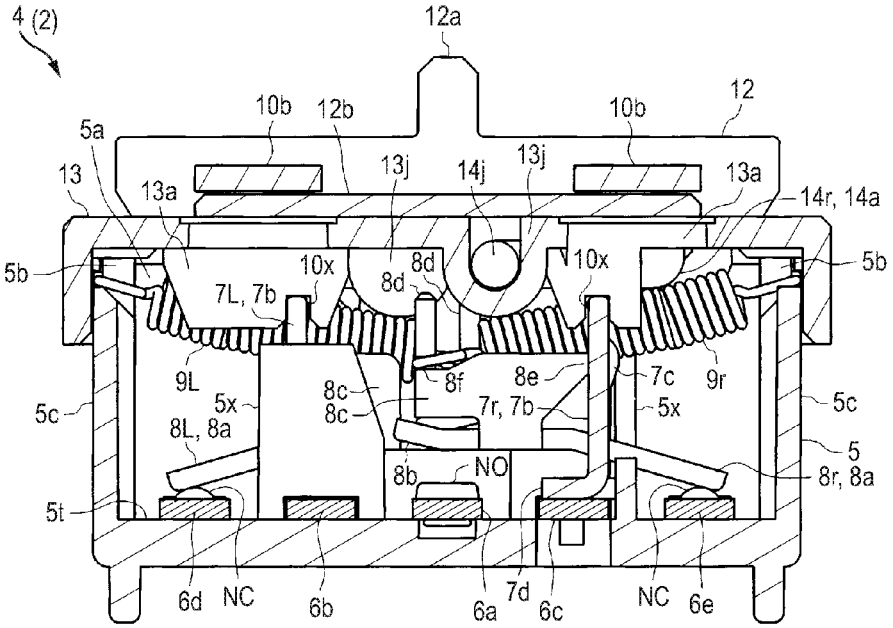
FIG. 14 is a cross-sectional view taken along the line E-E in FIG. 13.
Figure 15A:
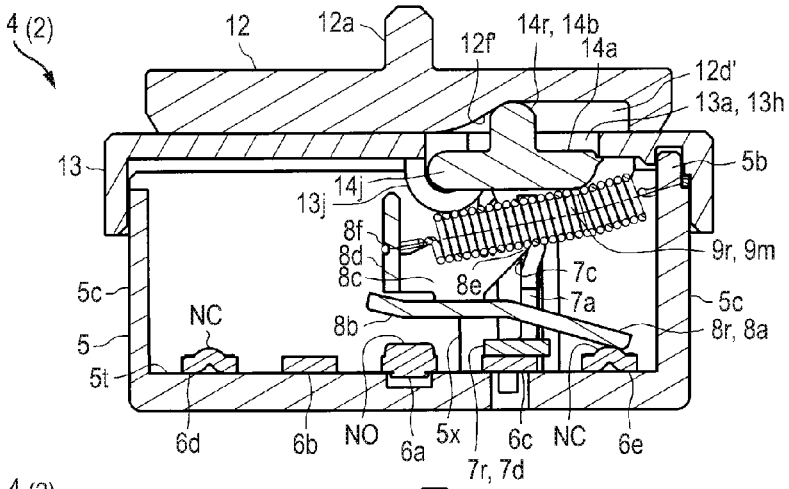
FIGS. 15A to 15C are cross-sectional views taken along the line F-F in FIG. 13.
Figure 15B:
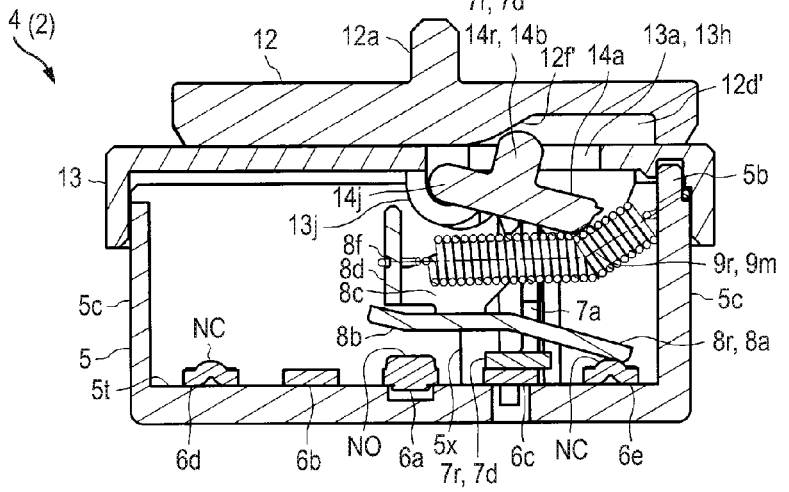
Figure 15C:
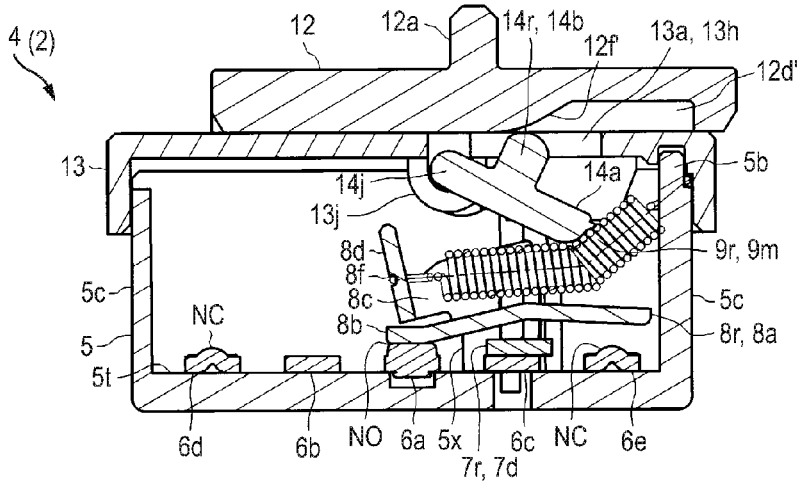
Figure 16A:
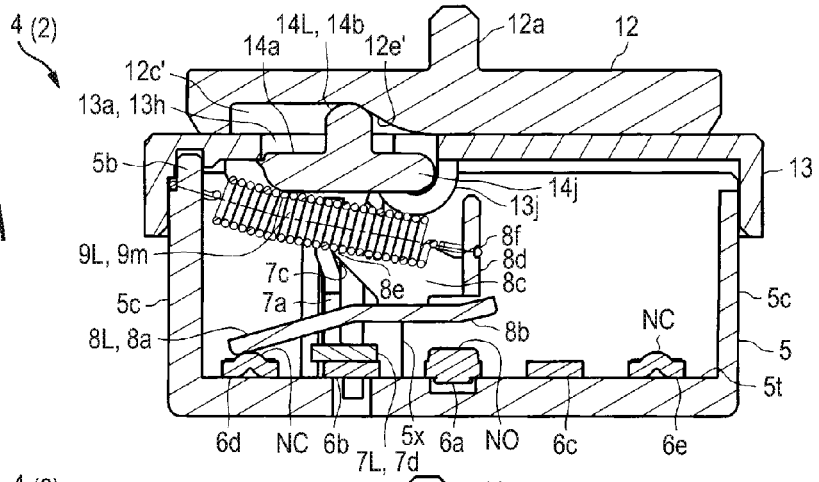
FIGS. 16A to 16C are cross-sectional views taken along the line G-G in FIG. 13.
Figure 16B:
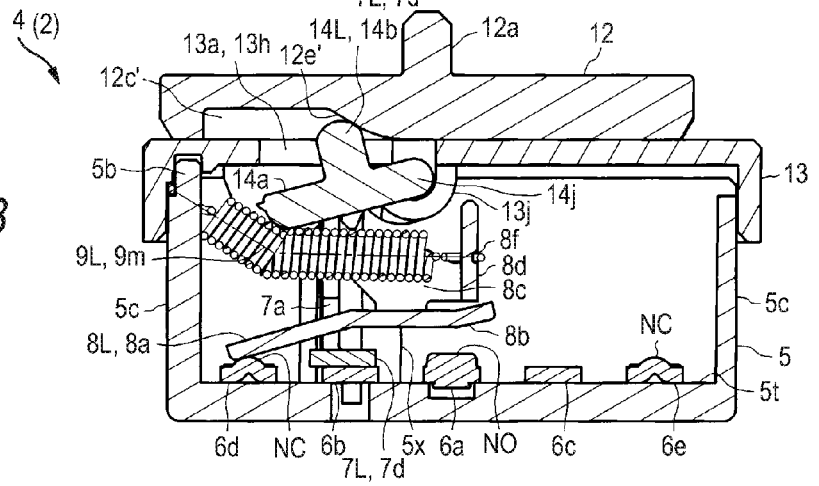
Figure 16C:
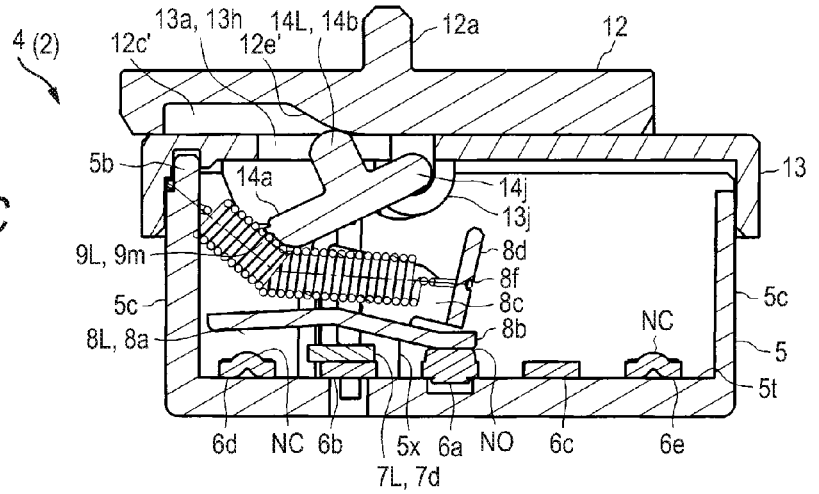

Specifically, FIG. 12 is an exploded perspective view of the switch $\mathbf{4}_{(2)}$. FIG. 13 is an assembly drawing of the switch $\mathbf{4}_{(2)}$. FIG. 14 is a cross-sectional view taken along the line E-E in FIG. 13. FIGS. 15A to 15C are cross-sectional views taken along the line F-F in FIG. 13 illustrating an operation of the switch $\mathbf{4}_{(2)}$. FIGS. 16A to 16C are cross-sectional views taken along the line G-G in FIG. 13 illustrating the operation of the switch $\mathbf{4}_{(2)}$.

As illustrated in FIG. 12, a pair of the pressing members 14L and 14*r* provided on the switch $\mathbf{4}_{(2)}$ include projections 14*b* formed on an upper surfaces at centers, rotating shafts 14*j* formed at end portions, and arm portions 14*a* extending sidewards from the rotating shaft 14*j*. A cover 13 is provided with a pair of first holding portions 13*a* configured to hold the pressing members 14L and 14*r* so as to be movable in the depth direction toward the bottom portion 5*t* of the case 5. The first holding portions 13*a* each includes a hole 13*h* penetrating through the cover 13 in the vertical direction, and a bearing portion 13*j* configured to support the rotating shaft 14*j* as illustrated in FIGS. 15A to 15C and FIGS. 16A to 16C.

The cover 13 is mounted on the case 5 so as to close the opening 5*a* of the case 5 (see FIG. 13 to FIG. 16C). The pressing members 14L and 14*r* are mounted on the respective first holding portions 13*a* of the cover 13 from above. Accordingly, as illustrated in FIGS. 15A to 15C and FIGS. 16A to 16C, the pressing members 14L and 14*r* penetrate through the cover 13, and are held by the cover 13 so as to be rotatable about the rotating shaft 14*j*. The pressing members 14L and 14*r* are supported at lower ends of the arm portions 14*a* by center portions 9*m* of the resilient members 9L and 9*r*.

The projections 12*b* formed on side surfaces of the operating member 12 are inserted into the second holding portions 10*b* formed on an upper portion of the cover 13 in parallel to the longitudinal direction of the cover 13 and the operating member 12 illustrated in FIG. 12. Accordingly, as illustrated in FIG. 13 to FIG. 16C, the operating member 12 is held on an upper portion of the cover 13 so as to be slidable in the lateral direction above the case 5 and the pressing member 141, and 14*r*.

The lower surface of the operating member 12 opposing the cover 13 is provided with engaging grooves 12*c*' and 12*d*' that allows engagement of projections 14*b* of the pressing member 14L and 14*r*. The engaging grooves 12*c*' and 12*d*' are provided with inclined surfaces 12*e*" and 12*f*' formed so as to be lowered as they go toward the operating portion 12*a* side.

When assembling the switch $\mathbf{4}_{(2)}$ having the structure as described above, the fixed terminals 6*a* to 6*e*, the supporting members 7L and 7*r*, the movable contact strips 8L and 8*r*, and the resilient members 9L and 9*r* are assembled upward in sequence in the interior of the case 5. Then, the cover 13 is mounted on the case 5, the opening 5*a* is closed by the cover 13, the pressing members 14L and 14*r* are mounted on the first holding portions 13*a* of the cover 13, and the pressing members 14L and 14*r* are provided above the resilient members 9L and 9*r*. The operating member 12 is mounted on the second holding portions 10*b* of the cover 13, so that the operating member 12 is slidably provided above the case 5 and the pressing members 14L and 14*r*. Accordingly, the switch $\mathbf{4}_{(2)}$ is assembled as illustrated in FIG. 13 to FIG. 16C.

The switch $\mathbf{4}_{(2)}$ assembled as described above is installed sideways in the module case 1 as illustrated in FIGS. 4A to 4C. In this state of installation, the operating portion 12*a* of the operating member 12 engages the depression 3*b* of the lever 3*a* of the knob 3.

Subsequently, an operation of the switch $\mathbf{4}_{(2)}$ will be described.

As illustrated in FIG. 4A, when the knob 3 is in a neutral state, the operating member 12 is at a neutral position. As illustrated in FIG. 16A and FIG. 15A, the pressing members 14L and 14*r* are pressed at projections 14*b* thereof by the inclined portions 15*e* and 15*f* of the operating member 15, and slightly press the center portions 9*m* of the resilient members 9L and 9*r* respectively at distal ends of the arm portions 14*a*. Accordingly, the resilient members 9L and 9*r* are slightly sagged and urge the end portions 8*b* of the movable contact strips 8L and 8*r* obliquely upward where the bosses 5*b* of the both side walls 5*c* of the case 5 are present, respectively. Therefore, the end portions 8*b* of the movable contact strips 8L and 8*r* separate from the normally-opened fixed contacts NO of the first fixed terminal 6*a*, while the other end portions 8*a* of the movable contact strips 8L and 8*r* are in contact with the normally-closed fixed contacts NC on the second fixed terminals 6*d* and 6*e*, respectively.

Since the supporting members 7L and 7*r* are normally in contact with the third fixed terminals 6*b* and 6*c* and the movable contact strips 8L and 8*r*, the third fixed terminals 6*b* and 6*c* and the second fixed terminals 6*c*1 and 6*e* are in conducting state via the supporting members 7L and 7*r* and the movable contact strips 8L and 8*r* respectively. Therefore, both current routes for normal rotation and for reverse rotation of the motor for opening and closing the window are in an opened state, and hence no current flows to the motor, whereby the motor and the window are standstill.

As illustrated in FIG. 4B, when the knob 3 is pivoted in the opening direction, the lever 3*a* pivots and the operating member 12 is slid in the first operating direction. As illustrated in FIG. 15B, the projection 14*b* of the pressing member 14*r* and the inclined surface 12*f*' of the operating member 12 slide, while the projection 14*b* is pressed by the inclined surface 12*f*', so that the pressing member 14*r* rotates clockwise in FIG. 15B about the rotating shaft 14*j*. Accordingly, the arm portion 14*a* of the pressing member 14*r* pivots downward, and makes the center portion 9*m* of the resilient member 9*r* sagged further downward and bent. In other words, in conjunction with the sliding operation of the operating member 12 in the first operating direction, the pressing member 14*r* presses the center portions 9*m* of the resilient member 9*r* downward.

As illustrated in FIG. 15C, when the operating member 12 slides in the first operating direction by a predetermined amount, the pressing member 14*r* rotates by a predetermined angle and presses the center portion 9*m* of the resilient member 9*r* downward with the arm portion 14*a* by a predetermined amount, the resilient member 9*r* is significantly bent and hence the end portions 8*b* of the movable contact strip 8*r* cannot be urged obliquely upward. The perpendicular portion 8*d* of the movable contact strip 8*r* is pulled downward by the resilient member 9*r*, and the movable contact strip 8*r* pivots by a seesaw movement counterclockwise in FIG. 15C about the projection 8*e* (FIG. 8). Then, the other end portion 8*a* of the movable contact strip 8*r* moves away from the normally-closed fixed contacts NC of the second fixed terminal 6*e* and the end portions 8*b* comes into contact with the normally-opened fixed contacts NO of the first fixed terminal 6*a*. Therefore, when the third fixed terminal 6*c* and the first fixed terminal 6*a* are brought into a conducting state via the supporting member 7*r* and the movable contact strip 8*r*, and the current route for normal rotation of the motor is brought into a closed state, whereby a current flows to the motor and the motor rotates normally, so that the window is opened.

As illustrated in FIG. 4C, when the front end portion 3*c* of the knob 3 is pulled upward and the knob 3 is pivoted in the closing direction, the lever 3*a* pivots and slides the operating member 12 in the second operating direction. As illustrated in FIG. 16B, the projection 14*b* of the pressing member 14L and the inclined surface 12*e*' of the operating member 12 slide, while the projection 14*b* is pressed by the inclined surface 12*e*', so that the pressing member 14L rotates counterclockwise in FIG. 16B about the rotating shaft 14*j*. Accordingly, the arm portion 14*a* of the pressing member 141 pivots downward, and make the center portion 9*m* of the resilient member 9L sagged further downward and bent. In other words, in conjunction with the sliding operation of the operating member 12 in the second operating direction, the pressing member 14L presses the center portions 9*m* of the resilient member 9L downward.

As illustrated in FIG. 16C, when the operating member 12 slides in the second operating direction by a predetermined amount, the pressing member 141 rotates by a predetermined angle and presses the center portion 9*m* of the resilient member 9L downward with the arm portion 14*a* by a predetermined amount, the resilient member 9L is significantly bent and hence the end portions 8*b* of the movable contact strip 8L cannot be urged obliquely upward. The perpendicular portion 8*d* of the movable contact strip 8L is pulled downward by the resilient member 9L, and the movable contact strip 8L pivots by a seesaw movement clockwise in FIG. 16C about the projection 8*e* (FIG. 8). Then, the other end portion 8*a* of the movable contact strip 8L moves away from the normally-closed fixed contacts NC of the second fixed terminal 6*d* and the end portions 8*b* comes into contact with the normally-opened fixed contacts NO of the first fixed terminal 6*a*. Therefore, when the third fixed terminal 6*b* and the first fixed terminal 6*a* are brought into a conducting state via the supporting member 7L and the movable contact strip 8L, and the current route for reverse rotation of the motor is brought into a closed state, whereby a current flows to the motor and the motor rotates reversely, so that the window is closed.

When the operation on the knob 3 is released, the knob 3 and the operating member 12 are restored to neutral state illustrated in FIGS. 4A, 15A and 16A by the restoration mechanism, which is not illustrated. Therefore, the projections 14*b* of the pressing members 14L and 14*r* are separated from the inclined surfaces 12*e*' and 12*f*' of the operating member 12, respectively, and the arm portions 14*a* are pushed upward by a resilient restoring force of the resilient members 9L and 9*r*, and the projections 14*b* engage the engaging grooves 12*c*' and 12*d*'. The resilient members 9L and 9*r* urge the end portions 8*b* of the movable contact strips 8L and 8*r* obliquely upward, respectively, so that the end portions 8*b* of the movable contact strips 81, and 8*r* separate from the normally-opened fixed contacts NO of the first fixed terminal 6*a*, while the other end portions 8*a* thereof are in contact with the normally-closed fixed contacts NC on the second fixed terminals 6*d* and 6*e*, respectively. Therefore, the third fixed terminals 6*b* and 6*c* are brought into a non-conducting state with respect to the first fixed terminal 6*a*, and are brought into a conducting state with respect to the second fixed terminals 6*d* and Be via the supporting members 7L and 7*r* and the movable contact strips 8L and 8*r*. Therefore, both current routes for normal rotation and for reverse rotation of the motor are in an opened state, and hence no current flows to the motor, whereby the motor and the window are standstill.

According to the switch $\mathbf{4}_{(2)}$ of the second embodiment described above, in conjunction with the sliding operation of the operating member 12 by the knob 3, the projections 14*b* of the pressing members 14L and 14*r* are pressed downward by the inclined surfaces 12*e*' and 12*f*' of the operating member 12 to rotate the pressing member 14L and 14*r* about the rotating shafts 14*j*. Then, the center portions 9*m* of the resilient members 9L and 9*r* are pressed by the arm portions 14*a* of the pressing members 14L and 14*r* to pivot the movable contact strips 8L and 8*r* by a seesaw movement, and the opened-closed state of the movable contact strips 8L and 8*r* and the fixed terminals 6*a* to 6*e* is switched. Therefore, the opening-closing state of the contact between the movable contact strips 8L and 8*r* and the fixed terminals 6*a* to 6*e* can be switched quickly without depending on the operating speed of the knob 3 and the operating member 12.

In the second embodiment described above, the fixed terminals 6*a* to 6*e*, the supporting members 7L and 7*r*, the movable contact strips 8L and 8*r*, and the resilient members 9L and 9*r* are assembled upward in sequence in the interior of the case 5. Then, the opening 5*a* of the case 5 is covered with the cover 13, and from the upper portion of the cover 13, the pressing member 14L and 14*r* and the operating member 12 are assembled in sequence. Therefore, assembly is easily achieved while viewing these members.

Furthermore, in the second embodiment described above, the amount of the sliding movement of the operating member 12 and the amount of the downward movement of the distal end sides of the arm portions 14*a* of the pressing member 14L and 14*r* may be changed by adjusting the lengths from the rotating shafts 14*j* of the pressing member 14L and 14*r* to the distal end portions of the arm portions 14. Therefore, in comparison with the structure of the first embodiment described above, the amount of sliding movement may be reduced by reducing the sizes of the inclined surfaces 12*e*' and 12*f*' and the engaging grooves 12*c*' and 12*d*' of the operating member 12, so that a reduction in frictional force between the operating member 12 and the pressing member 14L and 14*r*, and a reduction in size of the switch $4_{(2)}$ with respect to the operating direction of the operating member 12 are achieved.

In the invention, various embodiments may be employed other than those described thus far. For example, in the above-described embodiments, examples in which the covers 10 and 13, a pair of pressing members 11L, 11*r*, 14L, and 14*r*, and the operating member 12 are provided above a pair of resilient members 9L and 9*r* have been described. However, the invention is not limited thereto. In addition to this, for example, as a switch $4_{(3)}$ of a third embodiment illustrated in FIG. 17, a rotary operating member 15 including a pressing member, an operating member, and a cover formed integrally may be provided above the resilient members 9L and 9*r*.

The rotary operating member 15 includes a rotating shaft 15*j* provided at a center, an operating portion 15*a* provided above the rotating shaft 15*j*, and a pair of left and right pressing portions 15L and 15*r* provided on both sides of the rotating shaft 15*j*. The rotating shaft 15*j* is supported by a bearing hole 5*z* formed on the side walls of the case 5, so that the rotary operating member 15 is supported on the case 5 so as to be rotatable in the depth direction of the case 5, whereby the opening 5*a* is closed. A pair of the pressing portions 15L and 15*r* are supported by center portions 9*m* of the resilient members 9L and 9*r* from below. The operating portion 15*a* engages the depression 3*b* of the lever 3*a* of the knob 3 illustrated in FIGS. 4A to 4C.

Figure 17:
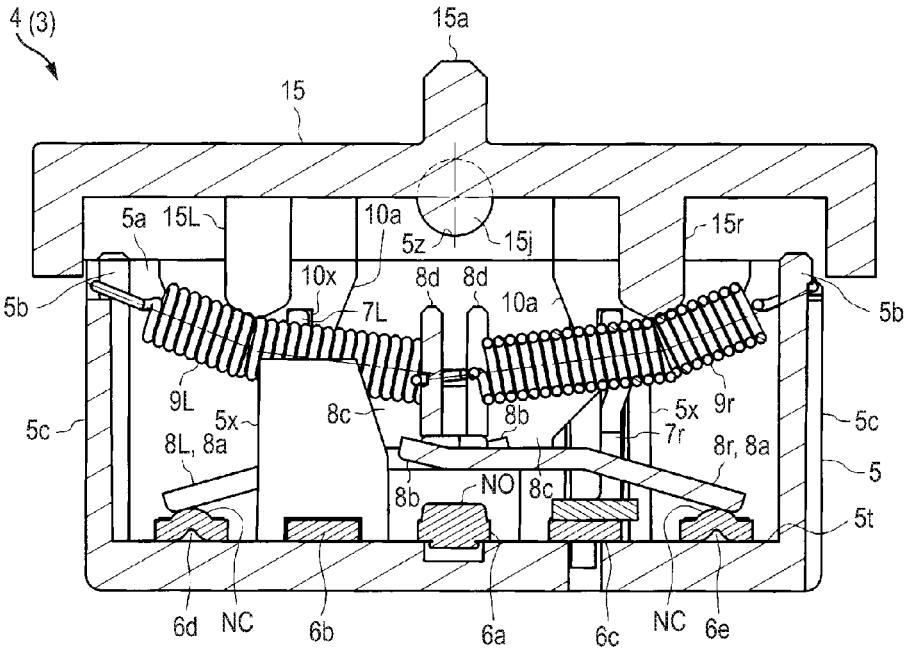
FIG. 17 is a cross sectional view of a switch of a third embodiment of the invention.

By pivoting the knob 3, the lever 3*a* rotates the rotary operating member 15 about the rotating shaft 15*j* via the operating portion 15*a* clockwise or counterclockwise in FIG. 17. Accordingly, the center portions 9*m* of the resilient members 9L and 9*r* are pressed by the pressing portions 15L and 15*r* to pivot the movable contact strips 8L and 8*r*, and the opened-closed state of the movable contact strips 8L and 8*r* and the fixed terminals 6*a* to 6*e* is switched.

According to the switch $4_{(3)}$ of the third embodiment described above, the opening-closing state between the movable contact strips 8L and 8*r* and the fixed terminals 6*a* to 6*e* can be switched quickly without depending on the operating speed of the knob 3 and the rotary operating member 15. What is essential is only that the fixed terminals 6*a* to 6*e*, the supporting members 7L and 7*r*, the movable contact strips 8L and 8*r*, and the resilient members 9L and 9*r* are installed in the case 5 and the rotary operating member 15 is mounted in the case 5. Therefore, assembly of the switch $4_{(3)}$ is facilitated. In addition, since the pressing member, the operating member, and the cover are integrally formed, the number of components is reduced, so that management of the components is also facilitated.

Figure 18:
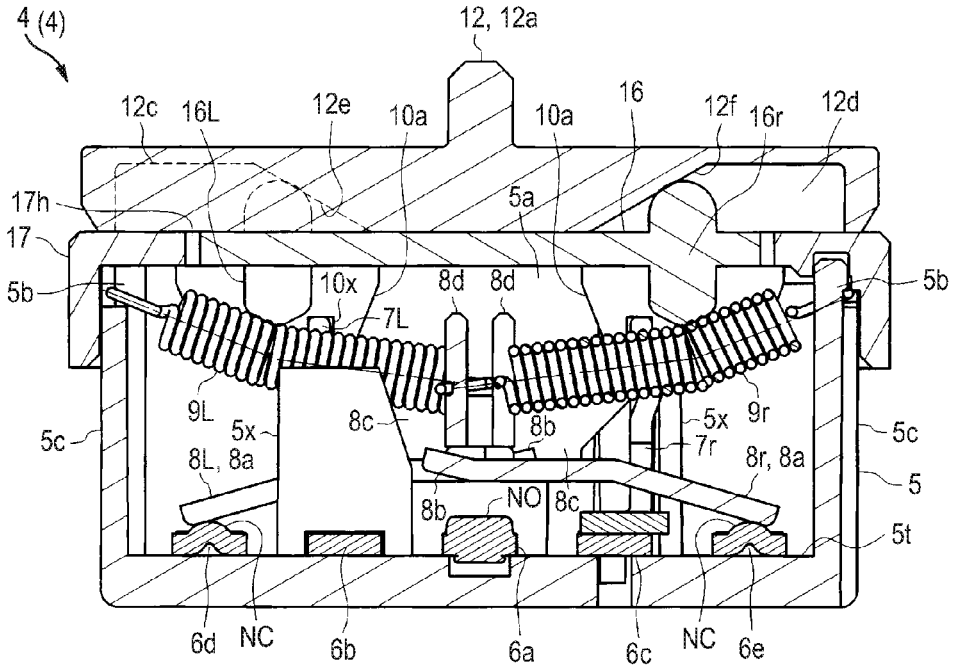
FIG. 18 is a cross sectional view of a switch of a fourth embodiment of the invention.

Like a switch $4_{(4)}$ of a fourth embodiment illustrated in FIG. 18, a single pressing member 16 having a pair of left and right pressing portions 16L and 16*r* may be provided between the resilient members 9L and 9*r* and the operating member 12. The pressing member 16 is fitted into the hole portion 17*h* formed in the cover 17 that closes the opening 5*a* of the case 5. What is to be done is just to mount the cover 17 and the pressing member 16 on the case 5 and then mount the operating member 12 on the cover 17.

When the operating member 12 is slid in the lateral direction, the inclined surfaces 12*e* and 12*f* slide against upper ends of the pressing portions 16L and 16*r*, so that the pressing member 16 is inclined. Accordingly, the center portions 9*m* of the resilient members 9L and 9*r* are pressed downward by lower ends of the pressing portions 16L and 16*r*, whereby the movable contact strips 8L and 8*r* pivot and the opened-closed state between the movable contact strips 8L and 8*r* and the fixed terminals 6*a* to 6*e* is switched.

In the embodiments described above, examples in which the resilient members 9L and 9*r* formed of a tensile coil spring are used has been described. However, the invention is not limited thereto and, for example, other resilient members such as leaf spring may be employed.

Furthermore, in the embodiments described above, an example in which the invention is applied to the switch 4 for the power window switch module 100 configured to manually open and close the windows of other seats other than the driver's seat of an automotive vehicle has been exemplified. However, the invention may be applied to switches other than those described above. The number of the components used is not limited to the embodiments described above, and may be selected as needed according to the function of the switch.

While the invention has been described with reference to a limited number of embodiments, those skilled in the art, having benefit of this disclosure, will appreciate that other embodiments can be devised which do not depart from the scope of the invention as disclosed herein. Accordingly, the scope of the invention should be limited by the attached claims.

What is claimed is:

1. A switch comprising:

a case comprising a bottom portion and a side wall;

a fixed terminal provided on the bottom portion of the case;

a supporting member provided in the case;

a movable contact strip supported by the supporting member so as to be pivotable in a vertical direction above the fixed terminal;

a resilient member which is hooked on both a projection provided on the side wall of the case and the movable contact strip, and which urges one end portion of the movable contact strip obliquely upward; and a pressing member provided above the resilient member, wherein the movable contact strip pivots and an opened-closed state between the movable contact strip and the fixed terminal is switched by pressing a center portion of the resilient member downward by the pressing member, wherein the fixed terminal comprises: a first fixed terminal provided with a normally-opened fixed contact; a second fixed terminal provided with a normally-closed fixed contact; and a third fixed terminal arranged between the both terminals, and wherein the resilient member urges the one end portion of the movable contact strip obliquely upward so as to cause the one end portion of the movable contact strip to be separated from the normally-opened fixed contact, and simultaneously causes the other end portion of the movable contact strip to be brought into contact with the normally-closed fixed contact.

2. The switch according to claim 1, further comprising:

an operating member provided above the case and the pressing member so as to be operable, wherein the pressing member presses the center portion of the resilient member downward in conjunction with the operation of the operating member.

3. The switch according to claim 2, wherein the pressing member and the operating member are integrally formed, are supported on the case so as to allow a rotational operation in a depth direction toward the bottom portion of the case, and press the center portion of the resilient member at the time of the rotational operation.

4. The switch according to claim 2, wherein the supporting member is formed of a conductive material, is mounted on the third fixed terminal, and brings the third fixed terminal and the movable contact strip into conduction, and wherein the movable contact strip causes the one end portion to be placed on the normally-opened fixed contact, and causes the other end portion to be placed on the normally-closed fixed contact.

5. The switch according to claim 2, wherein the first fixed terminal is provided alone in the case, wherein the second fixed terminal, the third fixed terminal, the supporting member, the movable contact strip, the resilient member, and the pressing member are provided in left and right pairs respectively on both sides of the first fixed terminal, wherein when the operating member is operated in a first operating direction, one of the pressing members presses a center portion of one of the resilient members and one of the movable contact strips pivots to switch an opened-closed state between one of the normally-closed fixed contacts and the normally-opened fixed contact, and wherein when the operating member is operated in a second operating direction, the other pressing member presses a center portion of the other resilient member and the other movable contact strip pivots, and an opened-closed state between the other normally-closed fixed contact and the normally-opened fixed contact is switched.

6. The switch according to claim 2, further comprising:

a cover which closes an opening opened on top of the case, wherein the pressing member comprises a rotating shaft, penetrates through the cover and is held by the cover so as to be rotatable in a depth direction toward a bottom portion of the case, and is supported by the resilient member from below, and wherein the operating member is held in an upper portion of the cover so as to be slidable in a lateral direction in which both end portions of the movable contact strip are arranged, and comprises an inclined surface which presses the pressing member downward to rotate toward the resilient member at a time of sliding operation on a surface opposing the cover.

7. The switch according to claim 6, wherein the fixed terminal comprises: a first fixed terminal provided with a normally-opened fixed contact; a second fixed terminal provided with a normally-closed fixed contact; and a third fixed terminal arranged between the both terminals, wherein the supporting member is formed of a conductive material, is mounted on the third fixed terminal, and brings the third fixed terminal and the movable contact strip into conduction, wherein the movable contact strip causes the one end portion to be placed on the normally-opened fixed contact, and causes the other end portion to be placed on the normally-closed fixed contact, and the resilient member urges the one end portion of the movable contact strip obliquely upward so as to cause the one end portion of the movable contact strip to be separated from the normally-opened fixed contact, and simultaneously causes the other end portion of the movable contact strip to be brought into contact with the normally-closed fixed contact.

8. The switch according to claim 7, wherein the first fixed terminal is provided alone in the case, wherein the second fixed terminal, the third fixed terminal, the supporting member, the movable contact strip, the resilient member, and the pressing member are provided in left and right pairs respectively on both sides of the first fixed terminal, wherein when the operating member is operated in a first operating direction, one of the pressing members presses a center portion of one of the resilient members and one of the movable contact strips pivots to switch an opened-closed state between one of the normally-closed fixed contacts and the normally-opened fixed contact, and wherein when the operating member is operated in a second operating direction, the other pressing member presses a center portion of the other resilient member and the other movable contact strip pivots, and an opened-closed state between the other normally-closed fixed contact and the normally-opened fixed contact is switched.

9. A switch comprising:

a case comprising a bottom portion and a side wall;

a fixed terminal provided on the bottom portion of the case;

a supporting member provided in the case;

a movable contact strip supported by the supporting member so as to be pivotable in a vertical direction above the fixed terminal;

a resilient member which is provided between the side wall of the case and the movable contact strip, and which urges one end portion of the movable contact strip obliquely upward; and a pressing member provided above the resilient member, wherein the movable contact strip pivots and an opened-closed state between the movable contact strip and the fixed terminal is switched b pressing a center portion of the resilient member downward by the pressing member, wherein the switch further comprises an operating member provided above the case and the pressing member so as to be operable, wherein the pressing member presses the center portion of the resilient member downward in conjunction with the operation of the operating member, wherein the switch further comprises a cover which closes an opening opened on top of the case, wherein the pressing member penetrates through the cover and is held by the cover so as to be movable in the vertical direction, and is supported by the center portion of the resilient member from below, and wherein the operating member is held by an upper portion of the cover so as to be slidable in a lateral direction in which both end portions of the movable contact strip are arranged, and comprises an inclined surface which presses the pressing member downward at a time of sliding movement on a surface opposing the cover.

10. The switch according to claim 9, wherein the fixed terminal comprises: a first fixed terminal provided with a normally-opened fixed contact; a second fixed terminal provided with a normally-closed fixed contact; and a third fixed terminal arranged between the both terminals, wherein the supporting member is formed of a conductive material, is mounted on the third fixed terminal, and brings the third fixed terminal and the movable contact strip into conduction, wherein the movable contact strip causes the one end portion to be placed on the normally-opened fixed contact, and causes the other end portion to be placed on the normally-closed fixed contact, and the resilient member urges the one end portion of the movable contact strip obliquely upward so as to cause the one end portion of the movable contact strip to be separated from the normally-opened fixed contact, and simultaneously causes the other end portion of the movable contact strip to be brought into contact with the normally-closed fixed contact.

11. The switch according to claim 10, wherein the first fixed terminal is provided alone in the case, wherein the second fixed terminal, the third fixed terminal, the supporting member, the movable contact strip, the resilient member, and the pressing member are provided in left and right pairs respectively on both sides of the first fixed terminal, wherein when the operating member is operated in a first operating direction, one of the pressing members presses a center portion of one of the resilient members and one of the movable contact strips pivots to switch an opened-closed state between one of the normally-closed fixed contacts and the normally-opened fixed contact, and wherein when the operating member is operated in a second operating direction, the other pressing member presses a center portion of the other resilient member and the other movable contact strip pivots, and an opened-closed state between the other normally-closed fixed contact and the normally-opened fixed contact is switched.

12. A method of assembling a switch comprising:

providing a fixed terminal on a bottom portion of a case comprising the bottom portion and a side wall, wherein the fixed terminal comprises: a first fixed terminal provided with a normally-opened fixed contact; a second fixed terminal provided with a normally-closed fixed contact; and a third fixed terminal arranged between the both terminals;

supporting a movable contact strip by the supporting member so as to be pivotable in a vertical direction above the fixed terminal in the case;

providing a resilient member hooked on both a projection provided on the side wall of the case and the movable contact strip;

urging one end portion of the movable contact strip obliquely upward by the resilient member;

providing a pressing member above the resilient member, and urging the one end portion of the movable contact strip obliquely upward by the resilient member so as to cause the one end portion of the movable contact strip to be separated from the normally-opened fixed contact, and simultaneously cause the other end portion of the movable contact strip to be brought into contact with the normally-closed fixed contact.

13. The method of assembling the switch according to claim 12, further comprising:

providing an operating member above the case and the pressing member so as to be operable.

* * * * *